US008851639B2

(12) United States Patent
Arimoto

(10) Patent No.: US 8,851,639 B2
(45) Date of Patent: Oct. 7, 2014

(54) LIQUID EJECTION APPARATUS

(71) Applicant: FUJIFILM Corporation, Tokyo (JP)

(72) Inventor: Makoto Arimoto, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 13/765,503

(22) Filed: Feb. 12, 2013

(65) Prior Publication Data

US 2013/0208059 A1 Aug. 15, 2013

(30) Foreign Application Priority Data

Feb. 14, 2012 (JP) ..... 2012-029443

(51) Int. Cl.
*B41J 2/175* (2006.01)
*B41J 2/18* (2006.01)
*B41J 2/14* (2006.01)

(52) U.S. Cl.
CPC ..... *B41J 2/175* (2013.01); *B41J 2202/11* (2013.01); *B41J 2202/12* (2013.01); *B41J 2/18* (2013.01); *B41J 2/14233* (2013.01); *B41J 2002/14241* (2013.01); *B41J 2002/14419* (2013.01)
USPC ..... 347/85; 347/89

(58) Field of Classification Search
USPC ..... 347/84, 85, 89, 93
See application file for complete search history.

(56) References Cited

U.S. PATENT DOCUMENTS 4,413,267 A * 11/1983 Hein ..... 347/89
7,802,878 B2 * 9/2010 Kyoso ..... 347/85
8,132,902 B2 * 3/2012 Shibata et al. ..... 347/89
8,205,973 B2 * 6/2012 Nitta et al. ..... 347/85
2007/0252860 A1 11/2007 Nitta et al.
2008/0136860 A1 6/2008 Kyoso
2008/0158321 A1 7/2008 Nitta et al.
2009/0102879 A1 4/2009 Katada et al.

(Continued)

FOREIGN PATENT DOCUMENTS

JP 2007-313884 A 12/2007
JP 2008-162285 A 7/2008
JP 2009-101516 A 5/2009
JP 2010-082823 A 4/2010

OTHER PUBLICATIONS

The extended European Search Report dated Jun. 11, 2013, which corresponds to EP Application No. 13154770.5-1701 and is related to U.S. Appl. No. 13/765,503.

(Continued)

*Primary Examiner* — Anh T. N. Vo
(74) *Attorney, Agent, or Firm* — Studebaker & Brackett PC

(57) ABSTRACT

A liquid ejection apparatus includes: a head including: a nozzle configured to eject liquid; a supply port to which the liquid is continuously supplied; and a recovery port from which the liquid is continuously recovered; a supply flow channel through which the liquid is supplied to the head; and a recovery flow channel through which the liquid is recovered from the head. A flow channel resistance inside the head from the supply port to the nozzle is R_HEAD_IN. A flow channel resistance inside the head from the nozzle to the recovery port is R_HEAD_OUT. A flow channel resistance of the supply flow channel is R_CHANNEL_IN. A flow channel resistance of the recovery flow channel is R_CHANNEL_OUT. The supply and recovery flow channels are laid out so as to satisfy a condition of R_CHANNEL_IN>R_CHANNEL_OUT when R_HEAD_IN>R_HEAD_OUT, or a condition of R_CHANNEL_IN<R_CHANNEL_OUT when R_HEAD_IN<R_HEAD_OUT.

22 Claims, 9 Drawing Sheets

(56) References Cited

U.S. PATENT DOCUMENTS

| | | | |
|---|---|---|---|
| 2010/0079514 | A1 | 4/2010 | Shibata |
| 2011/0242237 | A1 | 10/2011 | Uezawa |
| 2011/0316934 | A1 | 12/2011 | Nishikawa |

OTHER PUBLICATIONS

An Office Action; "Notification of Reasons for Rejection," issued by the Japanese Patent Office on Dec. 18, 2013, which corresponds to Japanese Patent Application No. 2012-029443 and is related to U.S. Appl. No. 13/765,503; with a partial translation.

* cited by examiner

LIQUID EJECTION APPARATUS

BACKGROUND OF THE INVENTION

1. Field of the Invention

The present invention relates to a liquid ejection apparatus, and more particularly to technology which optimizes a layout of flow channels in a liquid ejection apparatus in which liquid to be ejected from nozzles of a liquid ejection head is supplied to the liquid ejection head while circulated through the liquid ejection head.

2. Description of the Related Art

A liquid ejection head (e.g., an inkjet head, hereinafter referred simply to as the "head") configured to eject liquid (e.g., droplets of ink) has a problem in that ejection defects occur if the liquid inside the head contains bubbles or has the viscosity increased. In order to prevent such ejection defects caused by bubbles in the liquid inside the head or the increased viscosity of the liquid inside the head, it is known technology to supply the liquid to the head while circulating the liquid through the head.

In cases of supplying the liquid to the head while circulating the liquid through the head, it is necessary to stably supply the liquid to the head in order to accurately control the ejection of the liquid from the head. Here, "to stably supply the liquid" means to supply the liquid while suppressing pressure variation in the supplied liquid as far as possible.

For suppressing pressure variation in the supplied liquid, a method to arrange dampers in flow channels through which the liquid is supplied is known (see Japanese Patent Application Publication No. 2009-101516, for example).

Japanese Patent Application Publication No. 2007-313884 describes technology for suppressing pressure variation in the supplied liquid by controlling the energy per unit volume generated in the liquid inside a tank on the supply side and the energy per unit volume generated in the liquid inside a tank on the recovery side, so as to maintain a prescribed relationship.

SUMMARY OF THE INVENTION

There are two main approaches to reducing pressure variation in the supplied liquid. One approach is to use dampers, as described in Japanese Patent Application Publication No. 2009-101516. The other approach is to shorten the length of a tube for conveying the liquid to the head and/or to increase the internal diameter of the tube.

The use of dampers as in Japanese Patent Application Publication No. 2009-101516 is effective but requires space to arrange the dampers. Therefore, if there is no space capable of accommodating the dampers inside the liquid ejection apparatus, for instance, then a method based on shortening the tube length or increasing the tube diameter becomes important.

Shortening the tube length or increasing the tube diameter is effective in suppressing the pressure variation in the supplied liquid for the following reasons. The flow rate of the liquid passing through the head and the peripheral tubes varies with the ejection of droplets of the liquid from the head. The tube can be represented as an element having two properties of the flow channel resistance and the fluid inertance in terms of the fluid mechanics, and when likened to an element in an electric circuit, corresponds to an electric element having two properties of the electric resistance and the inductance. In this case, the fluid mechanic "pressure" corresponds to the electric "voltage". If a change in the flow rate of the liquid flowing through the tube occurs due to the droplet ejection of the liquid from the head, then the flow channel resistance and the fluid inertance of the tube contribute greatly to the pressure variation in the liquid supplied to the head. With respect to the tube having the length L and the diameter D, the magnitude R of the flow channel resistance of the tube is proportional to $LD^{-4}$, and the magnitude M of the fluid inertance of the tube is proportional to $LD^{-2}$. Hence, in order to reduce the flow channel resistance R and the fluid inertance M, it is effective to shorten the tube length L and/or to increase the tube diameter D.

Viewed from this perspective, when a liquid ejection apparatus having line heads is considered, since a large amount of liquid is ejected, if an inappropriate layout of flow channels of the liquid is selected (for instance, if the flow channels are made too long), then there is a concern that the pressure variation will become so large that it cannot be sufficiently eliminated with dampers.

Moreover, even if a layout of the flow channels is carefully designed, it is not physically possible to shorten all of the tubes.

In Japanese Patent Application Publication No. 2007-313884, the liquid pressure variations are suppressed by controlling the energy per unit volume generated in the liquid inside the tank on the supply side and the energy per unit volume generated in the liquid inside the tank on the recovery side, so as to maintain the prescribed condition; however, if high-speed printing is carried out, then there is a concern that the ejection cycle will become so short that the control cannot satisfactorily performed in response to the ejection.

The present invention has been contrived in view of these circumstances, an object thereof being to provide a liquid ejection apparatus capable of stably supplying liquid to be ejected from nozzles to a liquid ejection head and also capable of accurately controlling ejection of the liquid from the nozzles.

In order to attain the aforementioned object, the present invention is directed to a liquid ejection apparatus, comprising: a head including: a nozzle which is configured to eject liquid; a supply port to which the liquid is continuously supplied; and a recovery port from which the liquid is continuously recovered; a supply flow channel through which the liquid is supplied to the head; and a recovery flow channel through which the liquid is recovered from the head, wherein: a flow channel resistance inside the head from the supply port to the nozzle is R_HEAD_IN, a flow channel resistance inside the head from the nozzle to the recovery port is R_HEAD_OUT, a flow channel resistance of the supply flow channel is R_CHANNEL_IN, and a flow channel resistance of the recovery flow channel is R_CHANNEL_OUT; when R_HEAD_IN>R_HEAD_OUT, the supply flow channel and the recovery flow channel are laid out so as to satisfy a condition of R_CHANNEL_IN>R_CHANNEL_OUT; and when R_HEAD_IN<R_HEAD_OUT, the supply flow channel and the recovery flow channel are laid out so as to satisfy a condition of R_CHANNEL_IN<R_CHANNEL_OUT.

According to this aspect of the present invention, in the liquid ejection head which continuously supplies and recovers the liquid to be ejected from the nozzles (a so-called circulation head), the supply flow channel and the recovery flow channel are laid out on the basis of the flow channel resistances of the flow channels formed inside the head. There is a plurality of flow channels inside the circulation head. These flow channels inside the head are composed so as to have certain flow channel resistances on the supply side (the upstream side of the nozzles) and the recovery side (the downstream side of the nozzles). The flow rate of the liquid flowing through the flow channels inside the head varies when droplets of the liquid are ejected from the nozzles. Whether this variation is transmitted more readily to the supply flow channel or the recovery flow channel is governed by a ratio between the flow channel resistance of the supply flow channel inside the head and the flow channel resistance of the recovery flow channel inside the head. For example, if the supply flow channel resistance inside the head (R_HEAD_IN) is greater than the recovery flow channel resistance inside the head (R_HEAD_OUT), i.e., if R_HEAD_IN>R_HEAD_OUT, then the variation in the flow rate is readily transmitted to the recovery flow channel. Conversely, if the recovery flow channel resistance inside the head (R_HEAD_OUT) is greater than the supply flow channel resistance inside the head (R_HEAD_IN), i.e., if R_HEAD_IN<R_HEAD_OUT, then the variation in the flow rate is readily transmitted to the supply flow channel. Consequently, if the supply flow channel resistance inside the head (R_HEAD_IN) is greater than the recovery flow channel resistance inside the head (R_HEAD_OUT), i.e., if R_HEAD_IN>R_HEAD_OUT, then the supply flow channel and the recovery flow channel are laid out in such a manner that the flow channel resistance of the supply flow channel (R_CHANNEL_IN) is greater than the flow channel resistance of the recovery flow channel (R_CHANNEL_OUT). Conversely, if the recovery flow channel resistance inside the head (R_HEAD_OUT) is greater than the supply flow channel resistance inside the head (R_HEAD_IN), i.e., if R_HEAD_IN<R_HEAD_OUT, then the supply flow channel and the recovery flow channel are laid out in such a manner that the flow channel resistance of the recovery flow channel (R_CHANNEL_OUT) is greater than the flow channel resistance of the supply flow channel (R_CHANNEL_IN). In this way, in this aspect of the present invention, the supply flow channel and the recovery flow channel are laid out on the basis of the flow channel resistances of the flow channels formed inside the head. Accordingly, it is possible to effectively suppress the occurrence of pressure variations. Furthermore, by this means, it is possible to supply the liquid to be ejected from the nozzles, to the head stably, and the ejection of droplets the liquid from the nozzles can be controlled accurately. The layout of the flow channels is achieved, for example, by adjusting the diameters (flow channel diameters or tube diameters) and the lengths (flow channel lengths or tube lengths) of tubes which constitute the supply flow channel and the recovery flow channel, or by arranging a member serving as a resistance (for example, a filter). More specifically, the "layout" is a concept that does not only relate to adjusting or selecting the lengths and diameters of the tubes which constitute the flow channels, but also includes arranging a member which forms a resistance, such as a filter, in the flow channels.

Preferably, the supply flow channel and the recovery flow channel are laid out while flow channel diameters and flow channel lengths of the supply flow channel and the recovery flow channel are selected so as to satisfy the condition.

The flow channel resistance varies depending on the diameter (internal diameter) of the flow channel and the length of the flow channel. Therefore, in this aspect of the present invention, the supply flow channel and the recovery flow channel are laid out so as to satisfy the above-specified condition of the flow channel resistances by selecting the flow channel diameters and the flow channel lengths of the supply flow channel and the recovery flow channel. For example, if the supply flow channel resistance inside the head (R_HEAD_IN) is greater than the recovery flow channel resistance inside the head (R_HEAD_OUT), i.e., if R_HEAD_IN>R_HEAD_OUT, then the flow channel lengths (tube lengths) of the tubes constituting the recovery flow channel are made shorter than the flow channel lengths (tube lengths) of the tubes constituting the supply flow channel. Alternatively, the flow channel diameters (tube diameters) of the tubes constituting the recovery flow channel are made greater than the flow channel diameters (tube diameters) of the tubes constituting the supply flow channel. Conversely, if the recovery flow channel resistance inside the head (R_HEAD_OUT) is greater than the supply flow channel resistance inside the head (R_HEAD_IN), i.e., if R_HEAD_IN<R_HEAD_OUT, then the flow channel lengths of the tubes constituting the supply flow channel is made shorter than the flow channel lengths of the tubes constituting the recovery flow channel. Alternatively, the flow channel diameters of the tubes constituting the supply flow channel are made greater than the flow channel diameters of the tubes constituting the recovery flow channel. Accordingly, it is possible to effectively suppress the occurrence of pressure variation by a simple composition. Moreover, since the flow channels having a prescribed length or greater are permitted, on the basis of the ratio between the flow channel resistance of the supply flow channel formed inside the head and the flow channel resistance of the recovery flow channel formed inside the head, then it is possible to improve the freedom of the layout.

Preferably, the supply flow channel and the recovery flow channel are laid out while at least one of the supply flow channel and the recovery flow channel is provided with at least one of a filtering device and a deaeration device so as to satisfy the condition.

The filtering device or the deaeration device which is arranged in the flow channel has a high flow channel resistance. Therefore, for example, if the supply flow channel resistance inside the head (R_HEAD_IN) is greater than the recovery flow channel resistance inside the head (R_HEAD_OUT), i.e., if R_HEAD_IN>R_HEAD_OUT, then the filtering device or the deaeration device is arranged in the supply flow channel. Conversely, if the recovery flow channel resistance inside the head (R_HEAD_OUT) is greater than the supply flow channel resistance inside the head (R_HEAD_IN), i.e., if R_HEAD_IN<R_HEAD_OUT, then the filtering device or the deaeration device is arranged in the recovery flow channel. Consequently, the filtering device or the deaeration device can be arranged suitably, while suppressing pressure variation.

Preferably, the liquid ejection apparatus further comprises: a supply tank to which the supply flow channel is connected; and a recovery tank to which the recovery flow channel is connected, wherein the liquid is supplied to the head by a hydraulic head pressure differential between the supply tank and the recovery tank.

According to this aspect of the present invention, the liquid is supplied to and recovered from the head continuously by the hydraulic head pressure differential between the supply tank and the recovery tank. By supplying the liquid by means of the hydraulic head pressure differential, it is possible to supply the liquid more stably without any pulsations.

It is also preferable that the liquid ejection apparatus further comprises: a supply pump which is configured to convey the liquid to the head through the supply flow channel; a supply damper which is arranged in the supply flow channel; a recovery pump which is configured to convey the liquid from the head through the recovery flow channel; and a recovery damper which is arranged in the recovery flow channel.

According to this aspect of the present invention, the liquid is supplied to and recovered from the head continuously by the supply pump and the recovery pump. By using the pumps, it is possible to supply the liquid efficiently. On the other hand, by using the pumps, pulsation occurs in the liquid flowing in the flow channels, but by arranging the supply damper and the recovery damper, it is possible to eliminate the pulsating action of the pumps effectively. The supply damper is arranged between the supply pump and the head, and the recovery damper is arranged between the recovery pump and the head. Furthermore, in this case, the flow channel resistance from the supply damper to the head is the flow channel resistance of the supply flow channel (R_CHANNEL_IN), and the flow channel resistance from the head to the recovery damper is the flow channel resistance of the recovery flow channel (R_CHANNEL_OUT).

In order to attain the aforementioned object, the present invention is also directed to a liquid ejection apparatus, comprising: a head comprising a plurality of head modules, each of the head modules including: a nozzle which is configured to eject liquid; an individual supply port to which the liquid is continuously supplied; and an individual recovery port from which the liquid is continuously recovered; a plurality of individual supply flow channels through which the liquid is supplied respectively to the head modules; a common supply flow channel through which the liquid is supplied to the individual supply flow channels having distributary connections with the common supply flow channel; a plurality of individual recovery flow channels through which the liquid is recovered respectively from the head modules; and a common recovery flow channel through which the liquid is recovered from the individual recovery flow channels having tributary connections with the common recovery flow channel, wherein: a flow channel resistance inside each of the head modules from the individual supply port to the nozzle is R_MODULE_IN, a flow channel resistance inside each of the head modules from the nozzle to the individual recovery port is R_MODULE_OUT, a flow channel resistance of the common supply flow channel is R_C-CHANNEL_IN, and a flow channel resistance of the common recovery flow channel is R_C-CHANNEL_OUT; when R_MODULE_IN>R_MODULE_OUT, the common supply flow channel and the common recovery flow channel are laid out so as to satisfy a condition of R_C-CHANNEL_IN>R_C-CHANNEL_OUT; and when R_MODULE_IN<R_MODULE_OUT, the common supply flow channel and the common recovery flow channel are laid out so as to satisfy a condition of R_C-CHANNEL_IN<R_C-CHANNEL_OUT.

According to this aspect of the present invention, in the circulation head which is configured by joining together the plurality of head modules, the common supply flow channel and the common recovery flow channel are respectively laid out on the basis of the flow channel resistances of the flow channels inside the head modules. There are a plurality of flow channels inside the respective head modules constituting the head. For example, if the supply flow channel resistance inside the head module (R_MODULE_IN) is greater than the recovery flow channel resistance inside the head module (R_MODULE_OUT), i.e., if R_MODULE_IN>R_MODULE_OUT, then the variation in the flow rate is readily transmitted to the recovery flow channel. Conversely, if the recovery flow channel resistance inside the head module (R_MODULE_OUT) is greater than the supply flow channel resistance inside the head module (R_MODULE_IN), i.e., if R_MODULE_IN<R_MODULE_OUT, then the variation in the flow rate is readily transmitted to the supply flow channel. Consequently, if the supply flow channel resistance inside the head module (R_MODULE_IN) is greater than the recovery flow channel resistance inside the head module (R_MODULE_OUT), i.e., if R_MODULE_IN>R_MODULE_OUT, then the common supply flow channel and the common recovery flow channel are laid out in such a manner that the flow channel resistance of the common supply flow channel (R_C-CHANNEL_IN) is greater than the flow channel resistance of the common recovery flow channel (R_C-CHANNEL_OUT). Conversely, if the recovery flow channel resistance inside the head module (R_MODULE_OUT) is greater than the supply flow channel resistance inside the head module (R_MODULE_IN), i.e., if R_MODULE_IN<R_MODULE_OUT, then the common supply flow channel and the common recovery flow channel are laid out in such a manner that the flow channel resistance of the common recovery flow channel (R_C-CHANNEL_OUT) is greater than the flow channel resistance of the common supply flow channel (R_C-CHANNEL_IN). In this way, in this aspect of the present invention, the common supply flow channel and the common recovery flow channel are laid out on the basis of the flow channel resistances of the flow channels formed inside the head module. Accordingly, it is possible to effectively suppress the occurrence of pressure variations. Furthermore, by this means, it is possible to supply the liquid to be ejected from the nozzles, to the head stably, and the ejection of droplets of the liquid from the nozzles can be controlled accurately. The layout of the flow channels is achieved, for example, by adjusting the diameters (flow channel diameters or tube diameters) and the lengths (flow channel lengths or tube lengths) of tubes which constitute the supply flow channel and the recovery flow channel, or by arranging a member serving as a resistance (for example, a filter).

Preferably, a flow channel resistance of each of the individual supply flow channels is R_I-CHANNEL_IN, and a flow channel resistance of each of the individual recovery flow channels is R_I-CHANNEL_OUT; when R_MODULE_IN>R_MODULE_OUT, the individual supply flow channels, the individual recovery flow channels, the common supply flow channel and the common recovery flow channel are laid out so as to satisfy conditions of R_I-CHANNEL_IN>R_I-CHANNEL_OUT, and R_C-CHANNEL_IN>R_C-CHANNEL_OUT; and when R_MODULE_IN<R_MODULE_OUT, the individual supply flow channels, the individual recovery flow channels, the common supply flow channel and the common recovery flow channel are laid out so as to satisfy conditions of R_I-CHANNEL_IN<R_I-CHANNEL_OUT, and R_C-CHANNEL_IN<R_C-CHANNEL_OUT.

According to this aspect of the present invention, if the supply flow channel resistance inside the head module (R_MODULE_IN) is greater than the recovery flow channel resistance inside the head module (R_MODULE_OUT), i.e., if R_MODULE_IN>R_MODULE_OUT, then the individual supply flow channels and the individual recovery flow channels are laid out in such a manner that the flow channel resistance of the individual supply flow channel (R_I-CHANNEL_IN) is greater than the flow channel resistance of the individual recovery flow channel (R_I-CHANNEL_OUT), and the common supply flow channel and the common recovery flow channel are laid out in such a manner that the flow channel resistance of the common supply flow channel (R_C-CHANNEL_IN) is greater than the flow channel resistance of the common recovery flow channel (R_C-CHANNEL_OUT). Conversely, if the recovery flow channel resistance inside the head module (R_MODULE_OUT) is greater than the supply flow channel resistance inside the head module (R_MODULE_IN), i.e., if R_MODULE_IN<R_MODULE_OUT, then the individual supply flow channels and the individual recovery flow channels are laid out in such a manner that the flow channel resistance of the individual recovery flow channel (R_I-CHANNEL_OUT) is greater than the flow channel resistance of the individual supply flow channel (R_I-CHANNEL_IN), and the common supply flow channel and the common recovery flow channel are laid out in such a manner that the flow channel resistance of the common recovery flow channel (R_C-CHANNEL_OUT) is greater than the flow channel resistance of the common supply flow channel (R_C-CHANNEL_IN). In this way, in this aspect of the present invention, the individual supply flow channels, the individual recovery flow channels, the common supply flow channel and the common recovery flow channel are laid out on the basis of the flow channel resistances of the flow channels formed inside the head module. In other words, in cases where the pressure variation in the individual head modules cannot be ignored, the individual supply flow channels and the individual recovery flow channels are laid out on the basis of the flow channel resistances of the flow channels formed inside the head modules, as in this aspect of the present invention. Accordingly, it is possible to effectively suppress the occurrence of pressure variations. Furthermore, by this means, it is possible to supply the liquid to be ejected from the nozzles, to the head stably, and the ejection of droplets of the liquid from the nozzles can be controlled accurately.

Preferably, the individual supply flow channels, the individual recovery flow channels, the common supply flow channel and the common recovery flow channel are laid out while flow channel diameters and flow channel lengths of the individual supply flow channels, the individual recovery flow channels, the common supply flow channel and the common recovery flow channel are selected so as to satisfy the conditions.

The flow channel resistance varies with the diameter and length of the flow channel. Therefore, in this aspect of the present invention, the individual supply flow channels, the individual recovery flow channels, the common supply flow channel and the common recovery flow channel are laid out, so as to satisfy the above-specified condition of the flow channel resistances by selecting the flow channel diameters and the flow channel lengths of the individual supply flow channels, the individual recovery flow channels, the common supply flow channel and the common recovery flow channel. Accordingly, it is possible to effectively suppress the occurrence of pressure variation by a simple composition. Moreover, since the flow channels having a prescribed length or greater are permitted, on the basis of the ratio between the flow channel resistance of the supply flow channel formed inside the head and the flow channel resistance of the recovery flow channel formed inside the head, then it is possible to improve the freedom of the layout.

Preferably, the individual supply flow channels, the individual recovery flow channels, the common supply flow channel and the common recovery flow channel are laid out while at least one of the individual supply flow channels, the individual recovery flow channels, the common supply flow channel and the common recovery flow channel is provided with at least one of a filtering device and a deaeration device so as to satisfy the conditions.

The filtering device or the deaeration device which is arranged in the flow channel has a high flow channel resistance. Consequently, for example, if the supply flow channel resistance inside the head module (R_MODULE_IN) is greater than the recovery flow channel resistance inside the head module (R_MODULE_OUT), i.e., if R_MODULE_IN>R_MODULE_OUT, then the filtering device or the deaeration device is arranged in the common supply flow channel. Conversely, if the recovery flow channel resistance inside the head module (R_MODULE_OUT) is greater than the supply flow channel resistance inside the head module (R_MODULE_IN), i.e., if R_MODULE_IN<R_MODULE_OUT, then the filtering device or the deaeration device is arranged in the common recovery flow channel. Consequently, the filtering device or the deaeration device can be arranged suitably, while suppressing pressure variation.

Preferably, the liquid ejection apparatus further comprises: a supply tank to which the common supply flow channel is connected; and a recovery tank to which the common recovery flow channel is connected, wherein the liquid is supplied to the head by a hydraulic head pressure differential between the supply tank and the recovery tank.

According to this aspect of the present invention, the liquid is supplied to and recovered from the head (head modules) continuously by the hydraulic head pressure differential between the supply tank and the recovery tank. By supplying the liquid by means of the hydraulic head pressure differential, it is possible to supply the liquid more stably without any pulsations.

It is also preferable that the liquid ejection apparatus further comprises: a supply pump which is configured to convey the liquid to the head through the common supply flow channel; a supply damper which is arranged in the common supply flow channel; a recovery pump which is configured to convey the liquid from the head through the common recovery flow channel; and a recovery damper which is arranged in the common recovery flow channel.

According to this aspect of the present invention, the liquid is supplied to and recovered from the head (head modules) continuously by the supply pump and the recovery pump. By using the pumps, it is possible to supply the liquid efficiently. On the other hand, by using the pumps, pulsation occurs in the liquid flowing in the flow channels, but by arranging the supply damper and the recovery damper, it is possible to eliminate the pulsating action of the pumps effectively. The supply damper is arranged between the supply pump and the distributary points to the individual supply flow channels, and the recovery damper is arranged between the recovery pump and the tributary points of the individual recovery flow channels. Furthermore, in this case, the flow channel resistance from the supply damper to the distributary points is the flow channel resistance of the supply flow channel (R_C-CHANNEL_IN), and the flow channel resistance from the tributary points to the recovery damper is the flow channel resistance of the recovery flow channel (R_C-CHANNEL_OUT).

In order to attain the aforementioned object, the present invention is also directed to a liquid ejection apparatus, comprising: a head including: a nozzle which is configured to eject liquid; a supply port to which the liquid is continuously supplied; and a recovery port from which the liquid is continuously recovered; a supply flow channel through which the liquid is supplied to the head; and a recovery flow channel through which the liquid is recovered from the head, wherein: an inertance inside the head from the supply port to the nozzle is M_HEAD_IN, an inertance inside the head from the nozzle to the recovery port is M_HEAD_OUT, an inertance of the supply flow channel is M_CHANNEL_IN, and an inertance of the recovery flow channel is M_CHANNEL_OUT; when M_HEAD_IN>M_HEAD_OUT, the supply flow channel and the recovery flow channel are laid out so as to satisfy a condition of M_CHANNEL_IN>M_CHANNEL_OUT; and when M_HEAD_IN<M_HEAD_OUT, the supply flow channel and the recovery flow channel are laid out so as to satisfy a condition of M_CHANNEL_IN<M_CHANNEL_OUT.

According to this aspect of the present invention, in a so-called circulation head, the supply flow channel and the recovery flow channel are laid out on the basis of the inertances of the flow channels formed inside the head. As described above, whether the pressure variation caused by ejection of liquid from the nozzles is transmitted more readily to the supply flow channel or the recovery flow channel is governed by the flow channel resistances inside the head, and this also applies to the inertances inside the head. More specifically, whether the pressure variation is transmitted more readily to the supply flow channel or the recovery flow channel is governed by a ratio between the inertance of the supply flow channel formed inside the head and the inertance of the recovery flow channel formed inside the head. For example, if the supply side inertance inside the head (M_HEAD_IN) is greater than the recovery side inertance inside the head (M_HEAD_OUT), i.e., if M_HEAD_IN>M_HEAD_OUT, then the variation in the flow rate is readily transmitted to the recovery flow channel. Conversely, if the recovery side inertance inside the head (M_HEAD_OUT) is greater than the supply side inertance inside the head (M_HEAD_IN), i.e., if M_HEAD_IN<M_HEAD_OUT, then the variation in the flow rate is readily transmitted to the supply flow channel. Consequently, if the supply side inertance inside the head (M_HEAD_IN) is greater than the recovery side inertance inside the head (M_HEAD_OUT), i.e., if M_HEAD_IN>M_HEAD_OUT, then the supply flow channel and the recovery flow channel are laid out in such a manner that the inertance of the supply flow channel (M_CHANNEL_IN) is greater than the inertance of the recovery flow channel (M_CHANNEL_OUT). Conversely, if the recovery side inertance inside the head (M_HEAD_OUT) is greater than the supply side inertance inside the head (M_HEAD_IN), i.e., if M_HEAD_IN<M_HEAD_OUT, then the supply flow channel and the recovery flow channel are laid out in such a manner that the inertance of the recovery flow channel (M_CHANNEL_OUT) is greater than the inertance of the supply flow channel (M_CHANNEL_IN). In this way, in this aspect of the present invention, the supply flow channel and the recovery flow channel are laid out on the basis of the inertances of the flow channels formed inside the head. Accordingly, it is possible to effectively suppress the occurrence of pressure variations. Furthermore, by this means, it is possible to supply the liquid to be ejected from the nozzles, to the head stably, and the ejection of droplets of the liquid from the nozzles can be controlled accurately. The layout of the flow channels is achieved, for example, by adjusting the diameters (flow channel diameters or tube diameters) and the lengths (flow channel lengths or tube lengths) of tubes which constitute the supply flow channel and the recovery flow channel, or by arranging a member serving as a resistance (for example, a filter).

Preferably, the supply flow channel and the recovery flow channel are laid out while flow channel diameters and flow channel lengths of the supply flow channel and the recovery flow channel are selected so as to satisfy the condition.

The inertance varies with the diameter and length of the flow channel, similarly to the flow channel resistance. Therefore, in this aspect of the present invention, the supply flow channel and the recovery flow channel are laid out so as to satisfy so as to satisfy the above-specified condition of the inertances by selecting the flow channel diameters and the flow channel lengths of the supply flow channel and the recovery flow channel. For example, if the supply side inertance inside the head (M_HEAD_IN) is greater than the recovery side inertance inside the head (M_HEAD_OUT), i.e., if M_HEAD_IN>M_HEAD_OUT, then the flow channel lengths (tube lengths) of the tubes constituting the recovery flow channel are made shorter than the flow channel lengths (tube lengths) of the tubes constituting the supply flow channel. Alternatively, the flow channel diameters (tube diameters) of the tubes constituting the recovery flow channel are made greater than the flow channel diameters (tube diameters) of the tubes constituting the supply flow channel. Conversely, if the recovery side inertance inside the head (M_HEAD_OUT) is greater than the supply side inertance inside the head (M_HEAD_IN), i.e., if M_HEAD_IN<M_HEAD_OUT, then the flow channel lengths of the tubes constituting the supply flow channel are made shorter than the flow channel lengths of the tubes constituting the recovery flow channel. Alternatively, the flow channel diameters of the tubes constituting the supply flow channels are made greater than the flow channel diameters of the tubes constituting the recovery flow channel. Accordingly, it is possible to effectively suppress the occurrence of pressure variation by a simple composition. Moreover, since the flow channels having a prescribed length or greater are permitted, on the basis of the ratio between the inertance of the supply flow channel formed inside the head and the inertance of the recovery flow channel formed inside the head, then it is possible to improve the freedom of the layout.

Preferably, the supply flow channel and the recovery flow channel are laid out while at least one of the supply flow channel and the recovery flow channel is provided with at least one of a filtering device and a deaeration device so as to satisfy the condition.

The filtering device or the deaeration device which is arranged in the flow channel has a high flow channel resistance. Therefore, for example, if the supply side inertance inside the head (M_HEAD_IN) is greater than the recovery side inertance inside the head (M_HEAD_OUT), i.e., if M_HEAD_IN>M_HEAD_OUT, then the filtering device or the deaeration device is arranged in the supply flow channel. Conversely, if the recovery side inertance inside the head (M_HEAD_OUT) is greater than the supply side inertance inside the head (M_HEAD_IN), i.e., if M_HEAD_IN<M_HEAD_OUT, then the filtering device or the deaeration device is arranged in the recovery flow channel. Consequently, the filtering device or the deaeration device can be arranged suitably, while suppressing pressure variation.

Preferably, the liquid ejection apparatus further comprises: a supply tank to which the supply flow channel is connected; and a recovery tank to which the recovery flow channel is connected, wherein the liquid is supplied to the head by a hydraulic head pressure differential between the supply tank and the recovery tank.

According to this aspect of the present invention, the liquid is supplied to and recovered from the head continuously by the hydraulic head pressure differential between the supply tank and the recovery tank. By supplying the liquid by means of the hydraulic head pressure differential, it is possible to supply the liquid more stably without any pulsations.

It is also preferable that the liquid ejection apparatus further comprises: a supply pump which is configured to convey the liquid to the head through the supply flow channel; a supply damper which is arranged in the supply flow channel; a recovery pump which is configured to convey the liquid from the head through the recovery flow channel; and a recovery damper which is arranged in the recovery flow channel.

According to this aspect of the present invention, the liquid is supplied to and recovered from the head continuously by the supply pump and the recovery pump. By using the pumps, it is possible to supply the liquid efficiently. On the other hand, by using the pumps, pulsation occurs in the liquid flowing in the flow channels, but by arranging the supply damper and the recovery damper, it is possible to eliminate the pulsating action of the pumps effectively. The supply damper is arranged between the supply pump and the head, and the recovery damper is arranged between the recovery pump and the head. Furthermore, in this case, the inertance from the supply damper to the head is the inertance of the supply flow channel (M_CHANNEL_IN), and the inertance from the head to the recovery damper is the inertance of the recovery flow channel (M_CHANNEL_OUT).

In order to attain the aforementioned object, the present invention is also directed to a liquid ejection apparatus, comprising: a head comprising a plurality of head modules, each of the head modules including: a nozzle which is configured to eject liquid; an individual supply port to which the liquid is continuously supplied; and an individual recovery port from which the liquid is continuously recovered; a plurality of individual supply flow channels through which the liquid is supplied respectively to the head modules; a common supply flow channel through which the liquid is supplied to the individual supply flow channels having distributary connections with the common supply flow channel; a plurality of individual recovery flow channels through which the liquid is recovered respectively from the head modules; and a common recovery flow channel through which the liquid is recovered from the individual recovery flow channels having tributary connections with the common recovery flow channel, wherein: an inertance inside each of the head modules from the individual supply port to the nozzle is M_MODULE_IN, an inertance inside each of the head modules from the nozzle to the individual recovery port is M_MODULE_OUT, an inertance of the common supply flow channel is M_C-CHANNEL_IN, and an inertance of the common recovery flow channel is M_C-CHANNEL_OUT; when M_MODULE_IN>M_MODULE_OUT, the common supply flow channel and the common recovery flow channel are laid out so as to satisfy a condition of M_C-CHANNEL_IN>M_C-CHANNEL_OUT; and when M_MODULE_IN<M_MODULE_OUT, the common supply flow channel and the common recovery flow channel are laid out so as to satisfy a condition of M_C-CHANNEL_IN<M_C-CHANNEL_OUT.

According to this aspect of the present invention, in the circulation head which is configured by joining together the plurality of head modules, the common supply flow channel and the common recovery flow channel are respectively laid out on the basis of the inertances of the flow channels inside the head modules. There are a plurality of flow channels inside the respective head modules constituting the head. For example, if the supply side inertance inside the head module (M_MODULE_IN) is greater than the recovery side inertance inside the head module (M_MODULE_OUT), i.e., if M_MODULE_IN>M_MODULE_OUT, then the variation in the flow rate is readily transmitted to the recovery flow channel. Conversely, if the recovery side inertance inside the head module (M_MODULE_OUT) is greater than the supply side inertance inside the head module (M_MODULE_IN), i.e., if M_MODULE_IN<M_MODULE_OUT, then the variation in the flow rate is readily transmitted to the supply flow channel. Consequently, if the supply side inertance inside the head module (M_MODULE_IN) is greater than the recovery side inertance inside the head module (M_MODULE_OUT), i.e., if M_MODULE_IN>M_MODULE_OUT, then the common supply flow channel and the common recovery flow channel are laid out in such a manner that the inertance of the common supply flow channel (M_C-CHANNEL_IN) is greater than the inertance of the common recovery flow channel (M_C-CHANNEL_OUT). Conversely, if the recovery side inertance inside the head module (M_MODULE_OUT) is greater than the supply side inertance inside the head module (M_MODULE_IN), i.e., if M_MODULE_IN<M_MODULE_OUT, then the common supply flow channel and the common recovery flow channel are laid out in such a manner that the inertance of the common recovery flow channel (M_C-CHANNEL_OUT) is greater than the inertance of the common supply flow channel (M_C-CHANNEL_IN). In this way, in this aspect of the present invention, the individual supply flow channels, the individual recovery flow channels, the common supply flow channel and the common recovery flow channel are laid out on the basis of the inertances of the flow channels formed inside the head module. Accordingly, it is possible to effectively suppress the occurrence of pressure variations. Furthermore, by this means, it is possible to supply the liquid to be ejected from the nozzles, to the head stably, and the ejection of droplets of the liquid from the nozzles can be controlled accurately. The layout of the flow channels is achieved, for example, by adjusting the diameters (flow channel diameters or tube diameters) and the lengths (flow channel lengths or tube lengths) of tubes which constitute the supply flow channel and the recovery flow channel, or by arranging a member serving as a resistance (for example, a filter).

Preferably, an inertance of each of the individual supply flow channels is M_I-CHANNEL_IN, and an inertance of each of the individual recovery flow channels is M_I-CHANNEL_OUT; when M_MODULE_IN>M_MODULE_OUT, the individual supply flow channels, the individual recovery flow channels, the common supply flow channel and the common recovery flow channel are laid out so as to satisfy conditions of M_I-CHANNEL_IN>M_I-CHANNEL_OUT, and M_C-CHANNEL_IN>M_C-CHANNEL_OUT; and when M_MODULE_IN<M_MODULE_OUT, the individual supply flow channels, the individual recovery flow channels, the common supply flow channel and the common recovery flow channel are laid out so as to satisfy conditions of M_I-CHANNEL_IN<M_I-CHANNEL_OUT, and M_C-CHANNEL_IN<M_C-CHANNEL_OUT.

According to this aspect of the present invention, if the supply side inertance inside the head module (M_MODULE_IN) is greater than the recovery side inertance inside the head module (M_MODULE_OUT), i.e., if M_MODULE_IN>M_MODULE_OUT, then the individual supply flow channels and the individual recovery flow channels are laid out in such a manner that the inertance of the individual supply flow channel (M_I-CHANNEL_IN) is greater than the inertance of the individual recovery flow channel (M_I-CHANNEL_OUT), and the common supply flow channel and the common recovery flow channel are laid out in such a manner that the inertance of the common supply flow channel (M_C-CHANNEL_IN) is greater than the inertance of the common recovery flow channel (M_C-CHANNEL_OUT). Conversely, if the recovery side inertance inside the head module (M_MODULE_OUT) is greater than the supply side inertance inside the head module (M_MODULE_IN), i.e., if M_MODULE_IN<M_MODULE_OUT, then the individual supply flow channels and the individual recovery flow channels are laid out in such a manner that the inertance of the individual recovery flow channel (M_I-CHANNEL_OUT) is greater than the inertance of the individual supply flow channel (M_I-CHANNEL_IN), and the common supply flow channel and the common recovery flow channel are laid out in such a manner that the inertance of the common recovery flow channel (M_C-CHANNEL_OUT) is greater than the inertance of the common supply flow channel (M_C-CHANNEL_IN). In this way, in this aspect of the present invention, the individual supply flow channels, the individual recovery flow channels, the common supply flow channel and the common recovery flow channel are laid out on the basis of the inertances of the flow channels formed inside the head module. In other words, in cases where the pressure variation in the individual head modules cannot be ignored, the individual supply flow channels and the individual recovery flow channels are laid out on the basis of the inertances of the flow channels formed inside the head modules, as in this aspect of the present invention. Accordingly, it is possible to effectively suppress the occurrence of pressure variations. Furthermore, by this means, it is possible to supply the liquid to be ejected from the nozzles, to the head stably, and the ejection of droplets of the liquid from the nozzles can be controlled accurately.

Preferably, the individual supply flow channels, the individual recovery flow channels, the common supply flow channel and the common recovery flow channel are laid out while flow channel diameters and flow channel lengths of the individual supply flow channels, the individual recovery flow channels, the common supply flow channel and the common recovery flow channel are selected so as to satisfy the conditions.

The inertance varies with the diameter and length of the flow channel, similarly to the flow channel resistance. Therefore, in this aspect of the present invention, the individual supply flow channels, the individual recovery flow channels, the common supply flow channel and the common recovery flow channel are laid out so as to satisfy the above-specified condition of the inertances by selecting the flow channel diameters and the flow channel lengths of the individual supply flow channels, the individual recovery flow channels, the common supply flow channel and the common recovery flow channel. Accordingly, it is possible to effectively suppress the occurrence of pressure variation by a simple composition. Moreover, since the flow channels having a prescribed length or greater are permitted, on the basis of the ratio between the inertance of the supply flow channel formed inside the head and the inertance of the recovery flow channel formed inside the head, then it is possible to improve the freedom of the layout.

Preferably, the individual supply flow channels, the individual recovery flow channels, the common supply flow channel and the common recovery flow channel are laid out while at least one of the individual supply flow channels, the individual recovery flow channels, the common supply flow channel and the common recovery flow channel is provided with at least one of a filtering device and a deaeration device so as to satisfy the conditions.

The filtering device or the deaeration device which is arranged in the flow channel has a high flow channel resistance. Consequently, for example, if the supply side inertance inside the head module (M_MODULE_IN) is greater than the recovery side inertance inside the head module (M_MODULE_OUT), i.e., if M_MODULE_IN>M_MODULE_OUT, then the filtering device or the deaeration device is arranged in the common supply flow channel. Conversely, if the recovery side inertance inside the head module (M_MODULE_OUT) is greater than the supply side inertance inside the head module (M_MODULE_IN), i.e., if M_MODULE_IN<M_MODULE_OUT, then the filtering device or the deaeration device is arranged in the common recovery flow channel. Consequently, the filtering device or the deaeration device can be arranged suitably, while suppressing pressure variation.

Preferably, the liquid ejection apparatus further comprises: a supply tank to which the common supply flow channel is connected; and a recovery tank to which the common recovery flow channel is connected, wherein the liquid is supplied to the head by a hydraulic head pressure differential between the supply tank and the recovery tank.

According to this aspect of the present invention, the liquid is supplied to and recovered from the head (head modules) continuously by the hydraulic head pressure differential between the supply tank and the recovery tank. By supplying the liquid by means of the hydraulic head pressure differential, it is possible to supply the liquid more stably without any pulsations.

It is also preferable that the liquid ejection apparatus further comprises: a supply pump which is configured to convey the liquid to the head through the common supply flow channel; a supply damper which is arranged in the common supply flow channel; a recovery pump which is configured to convey the liquid from the head through the common recovery flow channel; and a recovery damper which is arranged in the common recovery flow channel.

According to this aspect of the present invention, the liquid is supplied to and recovered from the head (head modules) continuously by the supply pump and the recovery pump. By using the pumps, it is possible to supply the liquid efficiently. On the other hand, by using the pumps, pulsation occurs in the liquid flowing in the flow channels, but by arranging the supply damper and the recovery damper, it is possible to eliminate the pulsating action of the pumps effectively. The supply damper is arranged between the supply pump and the distributary points to the individual supply flow channels, and the recovery damper is arranged between the recovery pump and the tributary points of the individual recovery flow channels. Furthermore, in this case, the inertance from the supply damper to the distributary points is the inertance of the supply flow channel (M_C-CHANNEL_IN), and the inertance from the tributary points to the recovery damper is the inertance of the recovery flow channel (M_C-CHANNEL_OUT).

According to the present invention, it is possible to supply the liquid to be ejected from the nozzles, to the head stably, and the ejection of droplets of the liquid from the nozzles can be controlled accurately.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DESCRIPTION OF THE PREFERRED EMBODIMENTS

First Embodiment

Figure 1:
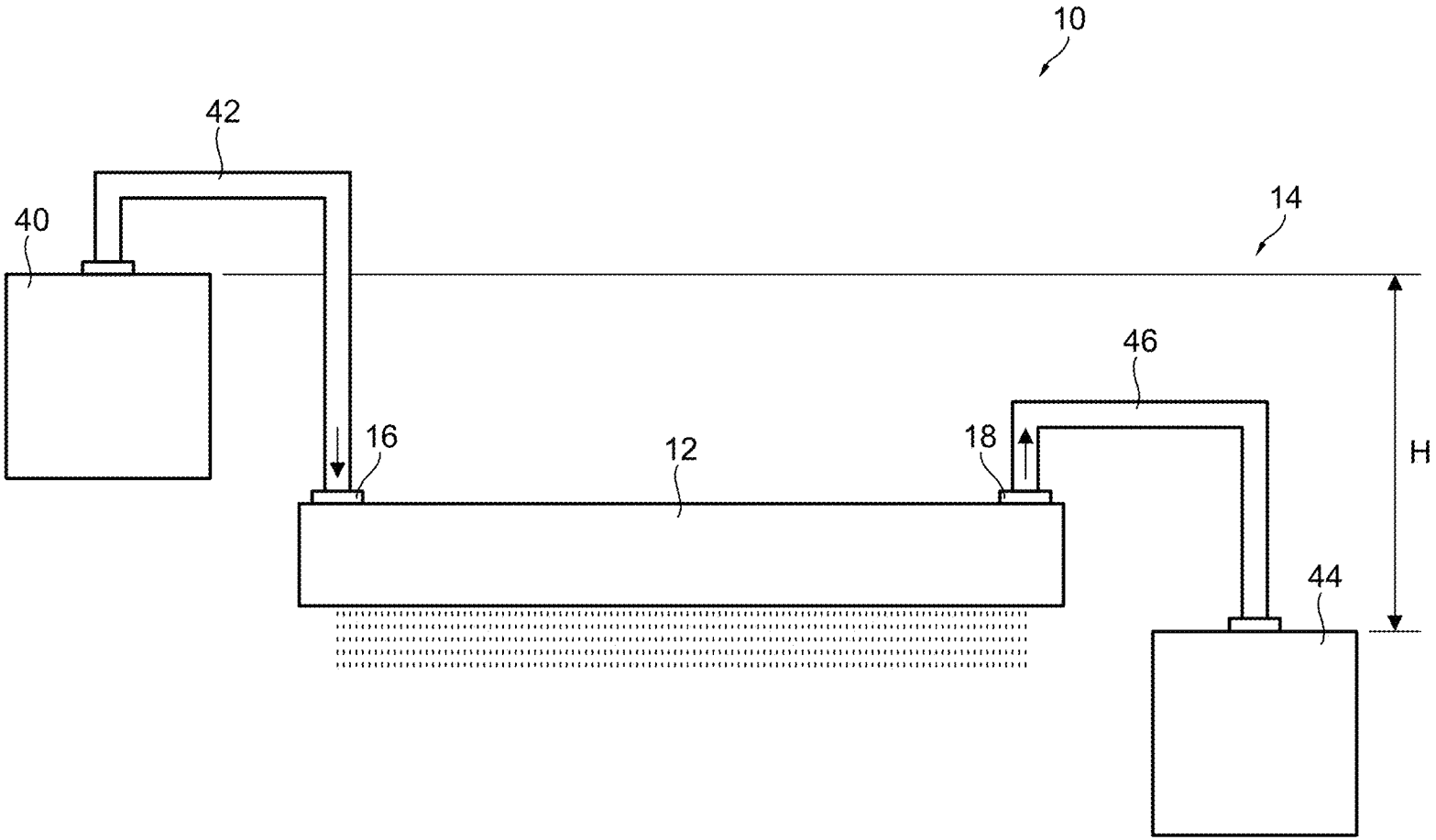
FIG. 1 is a schematic drawing of a liquid ejection apparatus according to a first embodiment of the present invention.

FIG. 1 is a schematic drawing of a liquid ejection apparatus 10 according to a first embodiment of the present invention.

As shown in FIG. 1, the liquid ejection apparatus 10 includes a liquid ejection head 12 (hereinafter referred simply as the "head" 12) configured to eject droplets of liquid, and a liquid supply and recovery unit 14 configured to supply and recovery the liquid to and from the head 12.

<Head>

The head 12 is a so-called circulation head, which is provided with a supply port 16 and a recovery port 18 for the liquid. The liquid is continuously supplied to the head 12 though the supply port 16 and is continuously recovered from the head 12 through the recovery port 18. Consequently, a flow of the liquid from the support port 16 toward the recovery port 18 is formed inside the head 12, and it is thereby possible to prevent the liquid inside the head 12 from keeping bubbles or increasing in the viscosity.

The head 12 is formed in a rectangular block shape, and a lower surface portion thereof is served as a nozzle face 20. The nozzle face 20 is formed with nozzles 22, through which droplets of the liquid are ejected from the head 12.

Figure 2:
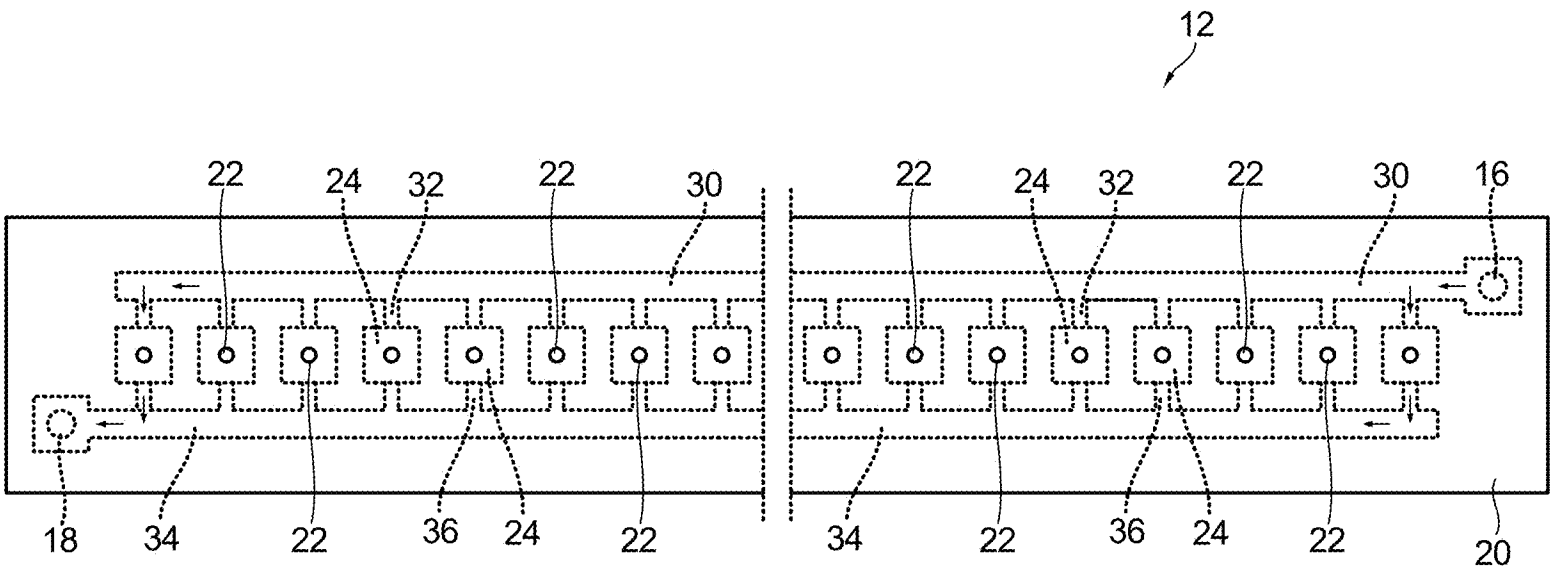
FIG. 2 is a plan view perspective diagram of a nozzle face of a liquid ejection head.

FIG. 2 is a plan view perspective diagram of the nozzle face 20 of the head 12.

As shown in FIG. 2, the plurality of nozzles 22 are formed at a uniform pitch on a single straight line along the lengthwise direction of the head 12. A plurality of pressure chambers 24 are formed at the uniform pitch on the same straight line inside the head 12, so as to correspond to the nozzles 22. The nozzles 22 are individually connected to the corresponding pressure chambers 24, respectively.

Figure 3:
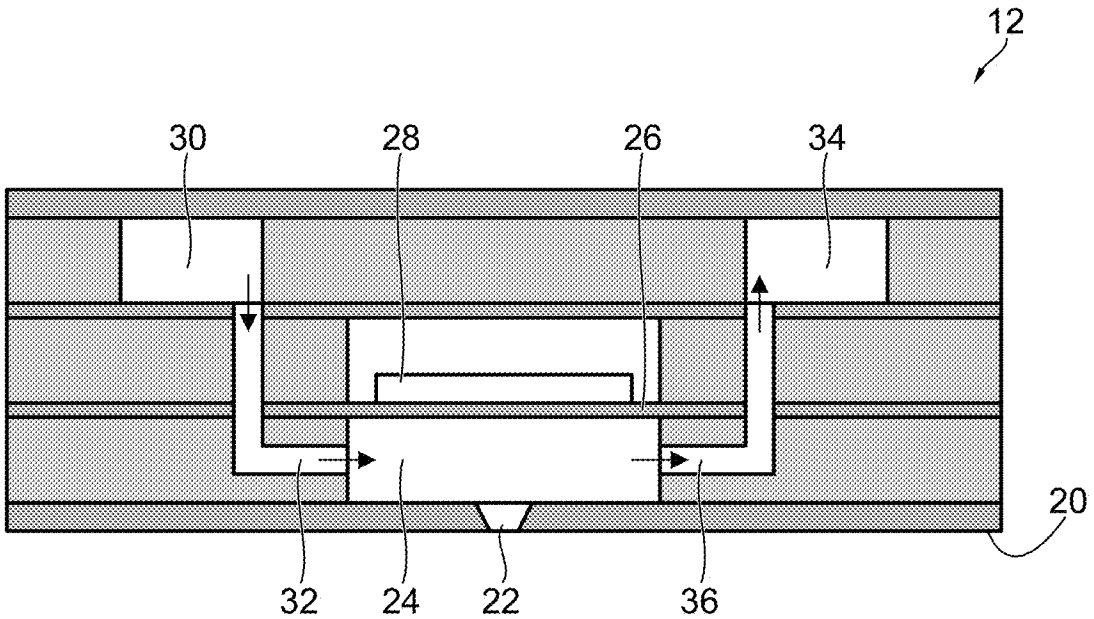
FIG. 3 is a longitudinal cross-sectional drawing showing an approximate structure of the interior of the head.

FIG. 3 is a longitudinal cross-sectional diagram showing an approximate structure of the interior of the head 12.

As shown in FIG. 3, the pressure chamber 24 is formed inside the head 12 as a parallelepiped shaped space. The ceiling face of the pressure chamber 24 is constituted of a diaphragm 26 and is configured to be deformable in the vertical direction in the drawing. The nozzle 22 is connected to a center of a bottom face section of the pressure chamber 24.

A piezoelectric element 28 is arranged on the diaphragm 26. When driving the piezoelectric element 28, a prescribed drive voltage is applied between an individual electrode (not shown), which is arranged on the piezoelectric element 28, and the diaphragm 26, which acts as a common electrode. By driving the piezoelectric element 28, the diaphragm 26 is deformed in the vertical direction in the drawing. Thereby, the pressure chamber 24 is expanded and contracted, and a droplet of the liquid contained in the pressure chamber 24 is ejected from the nozzle 22.

An internal common supply flow channel 30 is formed along the arrangement direction of the pressure chambers 24 inside the head 12. One end of the internal common supply flow channel 30 is connected to the supply port 16. The pressure chambers 24 are provided respectively with internal individual supply flow channels 32, through which the pressure chambers 24 are individually connected to the internal common supply flow channel 30.

Furthermore, an internal common recovery flow channel 34 is formed along the arrangement direction of the pressure chambers 24 inside the head 12. One end of the internal common recovery flow channel 34 is connected to the recovery port 18. The pressure chambers 24 are provided respectively with internal individual recovery flow channels 36, through which the pressure chambers 24 are individually connected to the internal common recovery flow channel 34.

When the liquid is supplied to the supply port 16, the supplied liquid flows through the internal common supply flow channel 30 to the internal individual supply flow channels 32, and is supplied to the respective pressure chambers 24. Then, the liquid supplied to the pressure chambers 24 flows through the internal individual recovery flow channels 36 to the internal common recovery flow channel 34, and arrives at the recovery port 18. Thus, it is possible to form the flow of the liquid inside the head 12 by continuously supplying the liquid to the supply port 16 and continuously recovering the liquid from the recovery port 18. In other words, it is possible to supply the liquid to the head 12 while circulating the liquid through the head 12.

<Liquid Supply and Recovery Unit>

As shown in FIG. 1, the liquid supply and recovery unit 14 includes a supply tank 40, a supply tube 42, a recovery tank 44 and a recovery tube 46. The liquid supply and recovery unit 14 supplies and recovers the liquid to and from the head 12 by means of the hydraulic head pressure differential between the supply tank 40 and the recovery tank 44.

The supply tank 40 stores the liquid to be supplied to the head 12.

The supply tube 42 constitutes the supply flow channel of the liquid and connects the supply tank 40 to the head 12, whereby the liquid stored in the supply tank 40 is conveyed to the head 12. One end of the supply tube 42 is connected to the supply tank 40 and the other end thereof is connected to the supply port 16 of the head 12.

The recovery tank 44 stores the liquid recovered from the head 12.

The recovery tube 46 constitutes the recovery flow channel and connects the head 12 to the recovery tank 44, whereby the liquid recovered from the head 12 is conveyed to the recovery tank 44. One end of the recovery tube 46 is connected to the recovery port 18 of the head 12 and the other end thereof is connected to the recovery tank 44.

Here, in order to apply a negative pressure to the liquid at the nozzle face, the supply tank 40 is disposed at a position higher than the recovery tank 44 (an upper position in the direction of gravity) or alternatively, the supply tank 40 is disposed at a position lower than the head 12 (a lower position in the direction of gravity). Thus, by means of the hydraulic head differential (H) between the supply tank 40 and the recovery tank 44, the liquid can be supplied continuously to the supply port 16 of the head 12 while applying the negative pressure to the liquid at the nozzle face, and the liquid can also be recovered continuously from the recovery port 18 of the head 12.

<Tube Layout>

The tube can be represented as an element having two properties of the flow channel resistance and the fluid inertance in terms of the fluid mechanics, and when likened to an element in an electric circuit, corresponds to an electric element having two properties of the electric resistance and the inductance.

Figure 4:
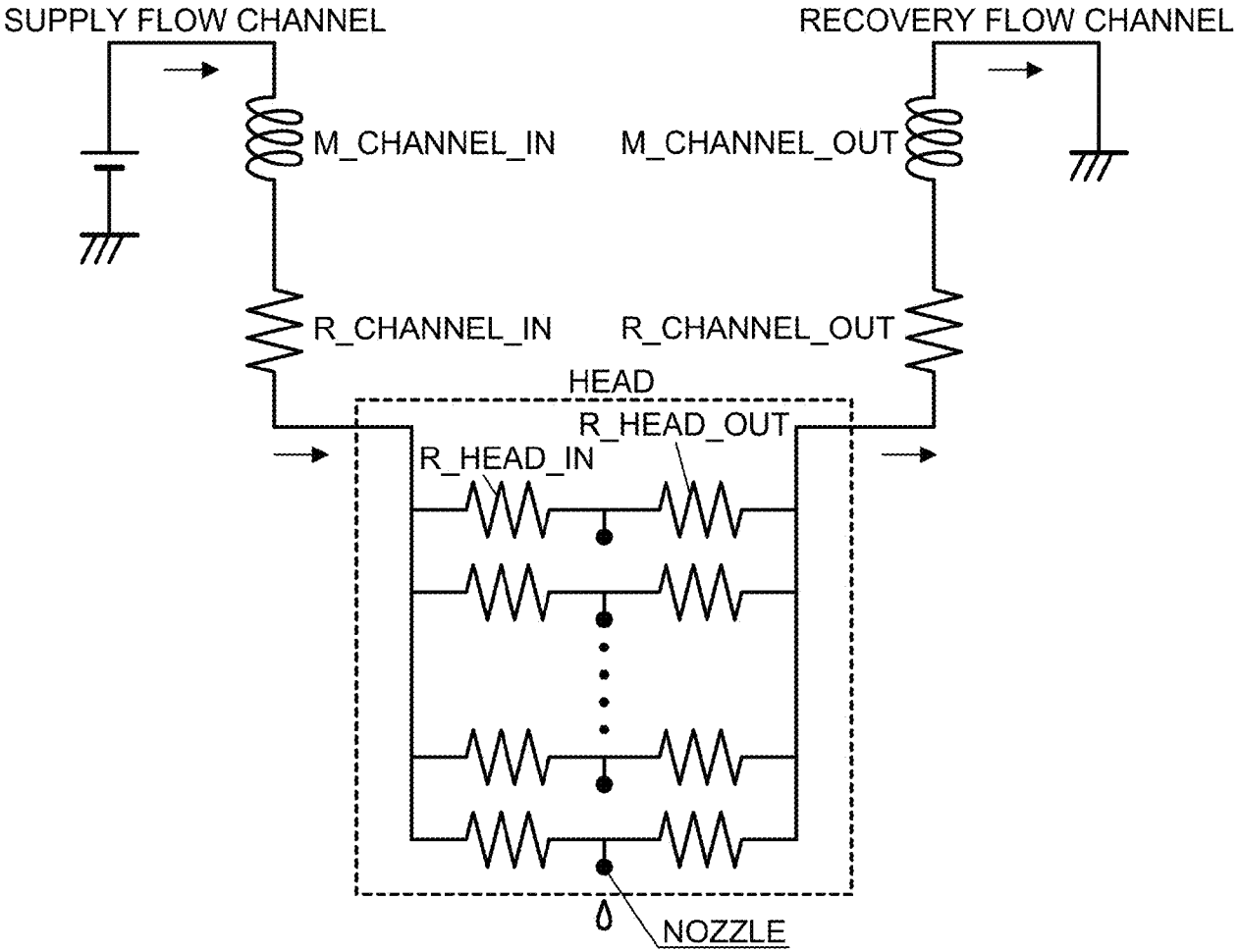
FIG. 4 is a diagram in which the liquid ejection apparatus according to the first embodiment is likened to an electric circuit.

FIG. 4 is a diagram in which the liquid ejection apparatus 10 according to the present embodiment is likened to an electric circuit. In FIG. 4, with respect to the flow channels inside the head, only the resistance components thereof are depicted and the inertance components thereof are not depicted so as to simplify the drawing.

In a circulation head, such as the head 12 according to the present embodiment, the plurality of flow channels are arranged inside the head (for example, the internal common supply flow channel 30, the internal individual supply flow channels 32, the internal common recovery flow channel 34 and the internal individual recovery flow channels 36 described above, and so on). These flow channels inside the head are composed so as to have certain flow channel resistances on the supply side (the upstream side of the nozzles) and the recovery side (the downstream side of the nozzles).

A flow rate of the liquid flowing through the flow channels inside the head 12 varies when droplets of the liquid are ejected from the nozzles 22. Whether this variation in the flow rate is transmitted more readily to the supply tube 42 or the recovery tube 46 is governed by the ratio between the flow channel resistance of the flow channel on the supply side inside the head 12 (i.e., the flow channel resistance of the flow channels from the supply port 16 to the nozzles 22) and the flow channel resistance of the flow channel on the recovery side inside the head 12 (i.e., the flow channel resistance of the flow channels from the nozzles 22 to the recovery port 18).

Here, the flow channel resistance of the supply flow channel inside the head 12 (the flow channel resistance from the supply port 16 to the nozzles 22) is referred to as R_HEAD_IN, the flow channel resistance of the recovery flow channel inside the head 12 (the flow channel resistance from the nozzles 22 to the recovery port 18) is referred to as R_HEAD_OUT, the flow channel resistance of the supply tube 42 is referred to as R_CHANNEL_IN, and the flow channel resistance of the recovery tube 46 is referred to as R_CHANNEL_OUT.

If the flow channel resistance of the supply flow channel inside the head 12 (R_HEAD_IN) is greater than the flow channel resistance of the recovery flow channel inside the head 12 (R_HEAD_OUT), i.e., if R_HEAD_IN>R_HEAD_OUT, then the variation in the flow rate is readily transmitted to the side of the recovery tube 46.

Conversely, if the flow channel resistance of the recovery flow channel inside the head 12 (R_HEAD_OUT) is greater than the flow channel resistance of the supply flow channel inside the head 12 (R_HEAD_IN), i.e., if R_HEAD_IN<R_HEAD_OUT, then the variation in the flow rate is readily transmitted to the side of the supply tube 42.

Therefore, if the flow channel resistance of the supply flow channel inside the head 12 (R_HEAD_IN) is greater than the flow channel resistance of the recovery flow channel inside the head 12 (R_HEAD_OUT), i.e., if R_HEAD_IN>R_HEAD_OUT, then the supply tube 42 and the recovery tube 46 are laid out in such a manner that the flow channel resistance of the supply tube 42 (R_CHANNEL_IN) is greater than the flow channel resistance of the recovery tube 46 (R_CHANNEL_OUT), i.e., so as to satisfy the condition of R_CHANNEL_IN>R_CHANNEL_OUT.

Conversely, if the flow channel resistance of the recovery flow channel inside the head 12 (R_HEAD_OUT) is greater than the flow channel resistance of the supply flow channel inside the head 12 (R_HEAD_IN), i.e., if R_HEAD_IN<R_HEAD_OUT, then the supply tube 42 and the recovery tube 46 are laid out in such a manner that the flow channel resistance of the recovery tube 46 (R_CHANNEL_OUT) is greater than the flow channel resistance of the supply tube 42 (R_CHANNEL_IN), i.e., so as to satisfy the condition of R_CHANNEL_IN<R_CHANNEL_OUT.

In this way, the supply tube 42 and the recovery tube 46 are laid out on the basis of the flow channel resistance of the supply flow channel inside the head 12 and the flow channel resistance of the recovery flow channel inside the head 12 so as to lower the flow channel resistance of the flow channel on the side suffering a larger variation in the flow rate. Consequently, it is possible to effectively suppress variation in the pressure generated as a result of ejection of droplets from the nozzles 22.

When the tube has the length L and the diameter D, the flow channel resistance R of the tube is proportional to $LD^{-4}$. Therefore, it is possible to achieve the layout that satisfies the above-specified condition by appropriately selecting the lengths and the diameters of the supply tube 42 and the recovery tube 46.

For example, if the flow channel resistance of the supply flow channel inside the head 12 (R_HEAD_IN) is greater than the flow channel resistance of the recovery flow channel inside the head 12 (R_HEAD_OUT), i.e., if R_HEAD_IN>R_HEAD_OUT, then it is possible to satisfy the above-specified condition by forming the supply tube 42 to be longer than the recovery tube 46. Conversely, if the flow channel resistance of the recovery flow channel inside the head 12 (R_HEAD_OUT) is greater than the flow channel resistance of the supply flow channel inside the head 12 (R_HEAD_IN), i.e., if R_HEAD_IN<R_HEAD_OUT, then it is possible to satisfy the above-specified condition by forming the recovery tube 46 to be longer than the supply tube 42.

Thus, the supply tube 42 and the recovery tube 46 can be laid out so as to satisfy the above-described condition by appropriately selecting the lengths and diameters of the tubes used. According to the present embodiment, the tube diameters and the tube lengths can be selected as desired provided that the above-specified condition is satisfied, and therefore the freedom of layout is improved.

It is also possible to satisfy the above-specified condition by arranging a filter (filtering device) or a deaeration pump (deaeration device) or the like, which has a high resistance, in the flow channel on the side suffering a smaller variation in the flow rate.

For example, if the flow channel resistance of the supply flow channel inside the head (R_HEAD_IN) is greater than the flow channel resistance of the recovery flow channel inside the head (R_HEAD_OUT), i.e., if R_HEAD_IN>R_HEAD_OUT, then it is possible to satisfy the above-specified condition by arranging the filter (filtering device) or the deaeration pump (deaeration device) on the side of the supply tube. Conversely, if the flow channel resistance of the recovery flow channel inside the head (R_HEAD_OUT) is greater than the flow channel resistance of the supply flow channel inside the head (R_HEAD_IN), i.e., if R_HEAD_IN<R_HEAD_OUT, then it is possible to satisfy the above-specified condition by arranging the filter (filtering device) or the deaeration pump (deaeration device) on the side of the recovery tube. Thereby, the filtering device, the deaeration device or the like, can be suitably arranged, while suppressing the occurrence of pressure variation.

In the liquid ejection apparatus 10 according to the present embodiment, it is thus possible to effectively suppress the occurrence of pressure variation by laying out the supply tube 42 and the recovery tube 46 on the basis of the ratio between the flow channel resistance of the supply flow channel inside the head 12 and the flow channel resistance of the recovery flow channel inside the head 12. Consequently, it is possible to supply the liquid to be ejected from the nozzles 22, to the head 12 stably, and the ejection of droplets of the liquid from the nozzles 22 can be controlled accurately.

In particular, the present embodiment has an especially effective function for heads having a larger number of nozzles, such as a line head mounted in a so-called line printer or the like, because the greater the number of nozzles in the head, the greater the volume of droplets of the liquid simultaneously ejected and hence the greater the likelihood of pressure variation occurring in the head.

The flow channel resistance of the supply flow channel inside the head (R_HEAD_IN) is the combined flow channel resistance of all of the flow channels which constitute the supply flow channel, and the flow channel resistance of the recovery flow channel inside the head (R_HEAD_OUT) is the combined flow channel resistance of all of the flow channels which constitute the recovery flow channel.

The flow channel resistance of the supply flow channel inside the head 12 is governed principally by the internal individual supply flow channels 32, and the flow channel resistance of the recovery flow channel inside the head 12 is governed principally by the internal individual recovery flow channels 36. Therefore, the combined flow channel resistance of the internal individual supply flow channels 32 can be taken as the flow channel resistance of the supply flow channel inside the head 12 (R_HEAD_IN), and the combined flow channel resistance of the internal individual recovery flow channels 36 can be taken as the flow channel resistance of the recovery flow channel inside the head 12 (R_HEAD_OUT), which correspond respectively to R_HEAD_IN and R_HEAD_OUT shown in FIG. 4.

As shown in FIG. 4, if the flow channels having the same flow channel resistance are arranged in parallel, then when these flow channels are considered together, they exhibit combined flow channel resistances similar to the electric resistances (i.e., 1/R_in_total=1/R_head_in1+1/R_head_in2+ . . . ; and 1/R_out_total=1/R_head_out1+1/R_head_out2+ . . . ). Consequently, the ratio between the combined flow channel resistance of the internal individual supply flow channels 32 and the combined flow channel resistance of the internal individual recovery flow channels 36 (the ratio between R_HEAD_IN and R_HEAD_OUT in FIG. 4) governs the ratio between the flow channel resistance of the supply flow channel inside the head 12 and the flow channel resistance of the recovery flow channel inside the head 12.

Consequently, if there is no variation in the flow channel resistance between the nozzles 22, then the ratio between the flow channel resistance of the internal individual supply flow channel 32 and the flow channel resistance of the internal individual recovery flow channel 36 (the ratio between R_HEAD_IN and R_HEAD_OUT in FIG. 4) directly governs the ratio between the overall flow channel resistances on the supply side and the recovery side.

If there is variation in the flow channel resistance between the nozzles, then it is possible to determine the overall flow channel resistance by calculating the combined flow channel resistance of the flow channels arranged in parallel.

<Tube Layout Based on Inertance>

The description given above relates to the method of laying out the supply tube 42 and the recovery tube 46 on the basis of the flow channel resistances; however, it is also possible to adopt a similar approach on the basis of the inertances.

In the circulation head, the flow channels formed inside the head are composed so as to have certain inertances on the supply side (the upstream side of the nozzles) and the recovery side (the downstream side of the nozzles). The flow rate of the liquid flowing through the flow channels inside the head 12 varies when droplets of the liquid are ejected from the nozzles 22. Whether this variation in the flow rate is transmitted more readily to the supply tube 42 or the recovery tube 46 is governed by the ratio between the inertance of the flow channel on the supply side inside the head 12 (i.e., the inertance from the supply port 16 to the nozzles 22) and the inertance of the flow channel on the recovery side inside the head 12 (i.e., the inertance from the nozzles 22 to the recovery port 18), similarly to the case based on the flow channel resistances.

Here, the inertance of the supply flow channel inside the head 12 (the inertance from the supply port 16 to the nozzles 22) is referred to as M_HEAD_IN, the inertance of the recovery flow channel inside the head 12 (the inertance from the nozzles 22 to the recovery port 18) is referred to as M_HEAD_OUT, the inertance of the supply tube 42 is referred to as M_CHANNEL_IN, and the inertance of the recovery tube 46 is referred to as M_CHANNEL_OUT.

If the inertance of the supply flow channel inside the head 12 (M_HEAD_IN) is greater than the inertance of the recovery flow channel inside the head 12 (M_HEAD_OUT), i.e., if M_HEAD_IN>M_HEAD_OUT, then the variation in the flow rate is readily transmitted to the side of the recovery tube 46.

Conversely, if the inertance of the recovery flow channel inside the head 12 (M_HEAD_OUT) is greater than the inertance of the supply flow channel inside the head 12 (M_HEAD_IN), i.e., if M_HEAD_IN<M_HEAD_OUT, then the variation in the flow rate is readily transmitted to the side of the supply tube 42.

Therefore, if the inertance of the supply flow channel inside the head 12 (M_HEAD_IN) is greater than the inertance of the recovery flow channel inside the head 12 (M_HEAD_OUT), i.e., if M_HEAD_IN>M_HEAD_OUT, then the supply tube 42 and the recovery tube 46 are laid out in such a manner that the inertance of the supply tube 42 (M_CHANNEL_IN) is greater than the inertance of the recovery tube 46 (M_CHANNEL_OUT), i.e., so as to satisfy the condition of M_CHANNEL_IN>M_CHANNEL_OUT.

Conversely, if the inertance of the recovery flow channel inside the head 12 (M_HEAD_OUT) is greater than the inertance of the supply flow channel inside the head 12 (M_HEAD_IN). i.e., if M_HEAD_IN<M_HEAD_OUT, then the supply tube 42 and the recovery tube 46 are laid out in such a manner that the inertance of the recovery tube 46 (M_CHANNEL_OUT) is greater than the inertance of the supply tube 42 (M_CHANNEL_IN), i.e., so as to satisfy the condition of M_CHANNEL_IN<M_CHANNEL_OUT.

In this way, the supply tube 42 and the recovery tube 46 are laid out on the basis of the inertance of the supply flow channel inside the head 12 and the inertance of the recovery flow channel inside the head 12 so as to lower the inertance of the flow channel on the side suffering a larger variation in the flow rate. Consequently, it is possible to effectively suppress variation in the pressure generated as a result of ejection of droplets from the nozzles 22.

When the tube has the length L and the diameter D, the inertance M of the tube is proportional to $LD^{-2}$. Therefore, it is possible to achieve the layout that satisfies the above-specified condition by appropriately selecting the lengths and the diameters of the supply tube 42 and the recovery tube 46.

For example, if the inertance of the supply flow channel inside the head 12 (M_HEAD_IN) is greater than the inertance of the recovery flow channel inside the head 12 (M_HEAD_OUT), i.e., if M_HEAD_IN>M_HEAD_OUT, then it is possible to satisfy the above-specified condition by forming the supply tube 42 to be longer than the recovery tube 46. Conversely, if the inertance of the recovery flow channel inside the head 12 (M_HEAD_OUT) is greater than the inertance of the supply flow channel inside the head 12 (M_HEAD_IN), i.e., if M_HEAD_IN<M_HEAD_OUT, then it is possible to satisfy the above-specified condition by forming the recovery tube 46 to be longer than the supply tube 42.

Similarly to the case based on the flow channel resistances, it is also possible to satisfy the above-specified condition by arranging a filter (filtering device) or a deaeration pump (deaeration device) or the like, which has a high resistance, in the flow channel on the side suffering a smaller variation in the flow rate.

For example, if the inertance of the supply flow channel inside the head (M_HEAD_IN) is greater than the inertance of the recovery flow channel inside the head (M_HEAD_OUT), i.e., if M_HEAD_IN>M_HEAD_OUT, then it is possible to satisfy the above-specified condition by arranging the filter (filtering device) or the deaeration pump (deaeration device) on the side of the supply tube. Conversely, if the inertance of the recovery flow channel inside the head (M_HEAD_OUT) is greater than the inertance of the supply flow channel inside the head (M_HEAD_IN), i.e., if M_HEAD_IN<M_HEAD_OUT, then it is possible to satisfy the above-specified condition by arranging the filter (filtering device) or the deaeration pump (deaeration device) on the side of the recovery tube. Thereby, the filtering device, the deaeration device or the like, can be suitably arranged, while suppressing the occurrence of pressure variation.

The inertance of the supply flow channel inside the head (M_HEAD_IN) is the combined inertance of all of the flow channels which constitute the supply flow channel, and the inertance of the recovery flow channel inside the head (M_HEAD_OUT) is the combined inertance of all of the flow channels which constitute the recovery flow channel.

Similarly to the flow channel resistances, the inertance of the supply flow channel inside the head 12 is principally governed by the internal individual supply flow channels 32, and the inertance of the recovery flow channel inside the head 12 is principally governed by the internal individual recovery flow channels 36. Therefore, the combined inertance of the internal individual supply flow channels 32 can be taken as the inertance of the supply flow channel inside the head 12 (M_HEAD_IN), and the combined inertance of the internal individual recovery flow channels 36 can be taken as the inertance of the recovery flow channel inside the head 12 (M_HEAD_OUT).

Consequently, if there is no variation in the inertance between the nozzles 22, then the ratio between the inertance of the internal individual supply flow channel 32 and the inertance of the internal individual recovery flow channel 36 (the ratio between M_HEAD_IN and M_HEAD_OUT in FIG. 4) directly governs the ratio between the overall inertances on the supply side and the recovery side.

If there is variation in the inertance between the nozzles, then it is possible to determine the overall inertance by calculating the combined inertance of the flow channels arranged in parallel.

Second Embodiment

Figure 5:
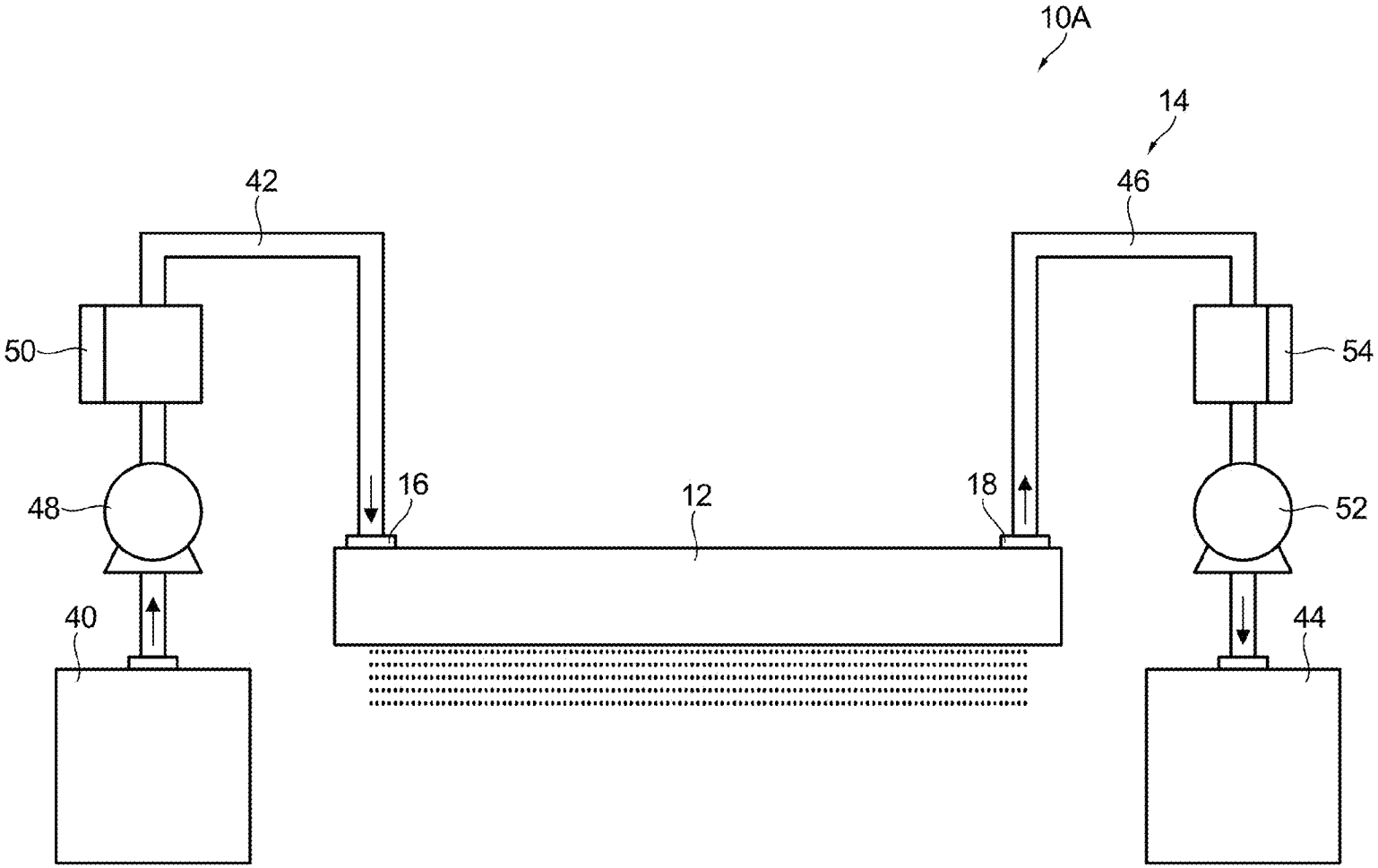
FIG. 5 is a schematic drawing of a liquid ejection apparatus according to a second embodiment of the present invention.

FIG. 5 is a schematic drawing of a liquid ejection apparatus 10A according to a second embodiment of the present invention.

As shown in FIG. 5, the liquid ejection apparatus 10A according to the present embodiment carries out the supply and recovery of the liquid by means of pumps. The composition of the head 12 is the same as the liquid ejection apparatus 10 according to the first embodiment described above, and therefore only the composition of the liquid supply and recovery unit 14 for carrying out the supply and recovery of the liquid to and from the head 12 is described here.

<Liquid Supply and Recovery Unit>

As shown in FIG. 5, the liquid supply and recovery unit 14 includes: a supply tank 40; a supply tube 42; a recovery tank 44; a recovery tube 46; a supply pump 48, which conveys the liquid contained in the supply tank 40 to the head 12 through the supply tube 42; a supply damper 50, which is arranged in the supply tube 42; a recovery pump 52, which conveys the liquid from the head 12 to the recovery tank 44 through the recovery tube 46; and a recovery damper 54, which is arranged in the recovery tube 46.

The supply tank 40 stores the liquid to be supplied to the head 12.

The supply tube 42 connects the supply tank 40 to the head 12, whereby the liquid stored in the supply tank 40 is conveyed to the head 12. One end of the supply tube 42 is connected to the supply tank 40 and the other end thereof is connected to the supply port 16 of the head 12.

The recovery tank 44 stores the liquid recovered from the head 12.

The recovery tube 46 connects the head 12 to the recovery tank 44, whereby the liquid recovered from the head 12 is conveyed to the recovery tank 44. One end of the recovery tube 46 is connected to the recovery port 18 of the head 12 and the other end thereof is connected to the recovery tank 44.

The supply pump 48 is disposed at an intermediate point of the supply tube 42. The supply pump 48 conveys the liquid contained in the supply tank 40, to the head 12 through the supply tube 42. The supply pump 48 is constituted of a tube pump, for example.

The supply damper 50 is disposed at an intermediate point of the supply tube 42. The supply damper 50 principally absorbs pressure variation (pulsation) of the liquid that occurs as a result of the driving of the supply pump 48. Therefore, the supply damper 50 is disposed between the supply pump 48 and the head 12.

The recovery pump 52 is disposed at an intermediate point of the recovery tube 46. The recovery pump 52 conveys the liquid from the head 12 to the recovery tank 44 through the recovery tube 46. The recovery pump 52 is constituted of a tube pump, for example. The recovery dumper 54 is disposed at an intermediate point of the recovery tube 46.

The recovery damper 54 principally absorbs pressure variation (pulsation) of the liquid that occurs as a result of the driving of the recovery pump 52. Therefore, the recovery damper 54 is disposed between the head 12 and the recovery pump 52.

When the supply pump 48 and the recovery pump 52 are driven, the liquid is supplied continuously from the supply tank 40 to the head 12, and the liquid is also recovered continuously from the head 12 to the recovery tank 44. In so doing, the supply pump 48 and the recovery pump 52 are driven and the liquid is supplied to the head 12, in such a manner that a negative pressure is applied to the liquid at the nozzle face.

<Tube Layout>

In the liquid ejection apparatus 10A according to the present embodiment also, the supply tube 42 and the recovery tube 46 are laid out on the basis of the ratio between the flow channel resistance of the supply flow channel inside the head 12 and the flow channel resistance of the recovery flow channel inside the head 12.

More specifically, if the flow channel resistance of the supply flow channel inside the head 12 (R_HEAD_IN) is greater than the flow channel resistance of the recovery flow channel inside the head 12 (R_HEAD_OUT), i.e., if R_HEAD_IN>R_HEAD_OUT, then the supply tube 42 and the recovery tube 46 are laid out in such a manner that the flow channel resistance of the supply tube 42 (R_CHANNEL_IN) is greater than the flow channel resistance of the recovery tube 46 (R_CHANNEL_OUT), i.e., so as to satisfy the condition of R_CHANNEL_IN>R_CHANNEL_OUT.

Conversely, if the flow channel resistance of the recovery flow channel inside the head 12 (R_HEAD_OUT) is greater than the flow channel resistance of the supply flow channel inside the head 12 (R_HEAD_IN), i.e., if R_HEAD_IN<R_HEAD_OUT, then the supply tube 42 and the recovery tube 46 are laid out in such a manner that the flow channel resistance of the recovery tube 46 (R_CHANNEL_OUT) is greater than the flow channel resistance of the supply tube 42 (R_CHANNEL_IN), i.e., so as to satisfy the condition of R_CHANNEL_IN<R_CHANNEL_OUT.

In the case of the present embodiment, the supply damper 50 is arranged in the supply tube 42, and the recovery damper 54 is arranged in the recovery tube 46. In this case, the supply tube 42 is laid out in such a manner that the region between the supply damper 50 and the head 12 satisfies the above-specified condition, and the recovery tube 46 is laid out in such a manner that the region between the head 12 and the recovery damper 54 satisfies the above-specified condition.

In this way, in the cases where the liquid is supplied to and recovered from the head 12 using the pumps also, the supply tube 42 and the recovery tube 46 are laid out on the basis of the flow channel resistance of the supply flow channel inside the head 12 and the flow channel resistance of the recovery flow channel inside the head 12. Consequently, it is possible to effectively suppress variation in the pressure generated as a result of ejection of droplets from the nozzles 22.

Similarly to the case of the first embodiment described above, the layout method involves adjusting the tube lengths and the tube diameters of the supply tube 42 and the recovery tube 46, for example. Furthermore, the layout method can also involve arranging a filter (filtering device) or a deaeration pump (deaeration device) or the like, which has a high resistance, in the flow channel on the side suffering a smaller variation in the flow rate.

Moreover, the description given above relates to the method of laying out the supply tube 42 and the recovery tube 46 on the basis of the flow channel resistances; however, similarly to the case of the first embodiment described above, it is also possible to lay out the supply tube 42 and the recovery tube 46 on the basis of the inertances.

More specifically, if the inertance of the supply flow channel inside the head 12 (M_HEAD_IN) is greater than the inertance of the recovery flow channel inside the head 12 (M_HEAD_OUT), i.e., if M_HEAD_IN>M_HEAD_OUT, then the supply tube 42 and the recovery tube 46 are laid out in such a manner that the inertance of the supply tube 42 (M_CHANNEL_IN) is greater than the inertance of the recovery tube 46 (M_CHANNEL_OUT), i.e., so as to satisfy the condition of M_CHANNEL_IN>M_CHANNEL_OUT.

Conversely, if the inertance of the recovery flow channel inside the head 12 (M_HEAD_OUT) is greater than the inertance of the supply flow channel inside the head 12 (M_HEAD_IN). i.e., if M_HEAD_IN<M_HEAD_OUT, then the supply tube 42 and the recovery tube 46 are laid out in such a manner that the inertance of the recovery tube 46 (M_CHANNEL_OUT) is greater than the inertance of the supply tube 42 (M_CHANNEL_IN), i.e., so as to satisfy the condition of M_CHANNEL_IN<M_CHANNEL_OUT.

Although the supply damper 50 and the recovery damper 54 are disposed in the supply tube 42 and the recovery tube 46 in the present embodiment, these dampers do not necessarily have to be disposed. If the supply damper 50 and the recovery damper 54 are not disposed, then the supply tube 42 is laid out in such a manner that the region between the supply pump 48 and the head 12 satisfies the above-specified condition, and the recovery tube 46 is laid out in such a manner that the region between the head 12 and the recovery pump 52 satisfies the above-specified condition.

Third Embodiment

Figure 6:
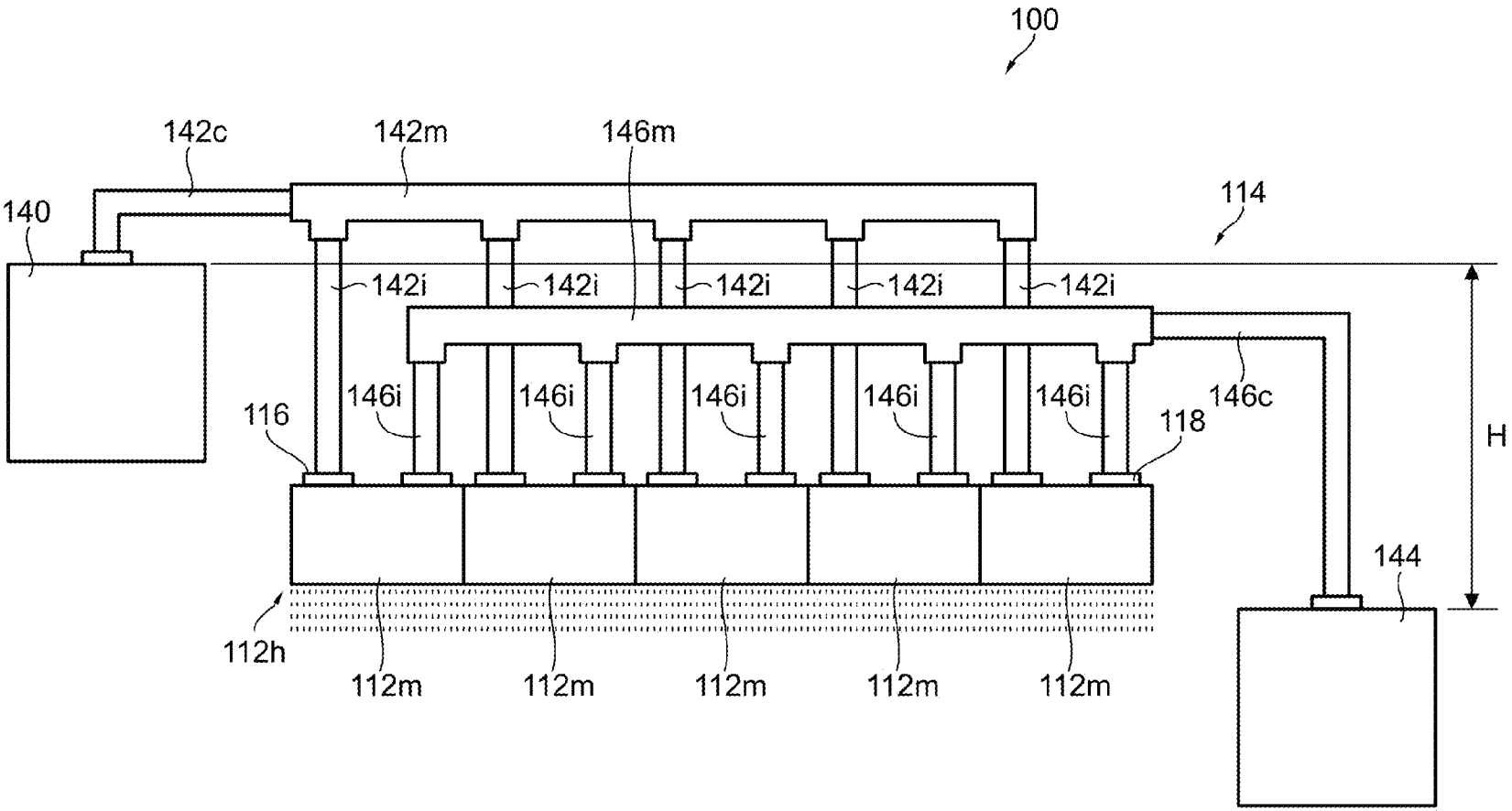
FIG. 6 is a schematic drawing of a liquid ejection apparatus according to a third embodiment of the present invention.

FIG. 6 is a schematic drawing of a liquid ejection apparatus 100 according to a third embodiment of the present invention.

As shown in FIG. 6, in the liquid ejection apparatus 100 according to the present embodiment, a liquid ejection head **112*h* is constituted by joining together a plurality of head modules 112*m*. The liquid is independently supplied to and recovered from each head module 112*m*, by the liquid supply and recovery unit 114**.

<Head>

As described above, the head **112*h* according to the present embodiment is constituted by joining together the plurality of head modules 112*m***.

The head modules **112*m* have the same structure. Furthermore, the basic structure of each head module 112*m* is the same as the head 12 according to the first embodiment described above. More specifically, each of the head modules 112*m* is provided with a supply port 116 and a recovery port 118, and the liquid is supplied continuously to the supply port 116 and is also recovered continuously from the recovery port 118 (in other words, the liquid can be supplied to each head module 112*m* while circulated through each head module 112*m*). The liquid supplied to the supply port 116 is supplied to the pressure chambers through the supply flow channels (the common supply flow channel and the individual supply flow channels, etc.) inside each head module 112*m*. Furthermore, the liquid supplied to the pressure chambers is recovered from the recovery port 118 through the recovery flow channels (the individual recovery flow channels, the common recovery flow channel, etc.) inside each head module 112*m***. By driving the piezoelectric elements arranged on the respective pressure chambers, droplets of the liquid are ejected from the nozzles connected to the pressure chambers.

The nozzles are formed in the nozzle face of each head module **112*m*, and the plurality of the nozzles are formed at a uniform pitch on a single straight line in the nozzle face of each head module 112*m*. The head modules 112*m*** are joined together in such a manner that the nozzle rows formed on the nozzle faces thereof are positioned on the same straight line. Consequently, it is possible to form a long head (a line head).

<Liquid Supply and Recovery Unit>

As shown in FIG. 6, the liquid supply and recovery unit 114 includes: a supply tank 140; a common supply tube **142*c*; individual supply tubes 142*i*; a supply manifold 142*m*, which connects the common supply tube 142*c* to the individual supply tubes 142*i*; a recovery tank 144; individual recovery tubes 146*i*; a common recovery tube 146*c*; and a recovery manifold 146*m*, which connects the individual recovery tubes 146*i* to the common recovery tube 146*c*. The liquid supply and recovery unit 114 supplies and recoveries the liquid to and from the head modules 112*m* of the head 112*h* by means of the hydraulic head pressure differential between the supply tank 140 and the recovery tank 144**.

The supply tank 140 stores the liquid to be supplied to the respective head modules **112*m* of the head 112*h***.

The individual supply tubes **142*i* constitute the supply flow channel of the liquid, and are connected respectively to the head modules 112*m*, whereby the liquid is conveyed individually to the respective head modules 112*m*. One end of each of the individual supply tubes 142*i* is connected to the supply manifold 142***m*, and the other end thereof is connected to the supply port 116 of each head module 112*m*.

The common supply tube 142*c* constitutes the supply flow channel of the liquid, and is formed as a single tube, through which the liquid is conveyed from the supply tank 140. One end of the common supply tube 142*c* is connected to the supply tank 140, and the other end thereof is connected to the supply manifold 142*m*.

The supply manifold 142*m* gathers and connects the individual supply tubes 142*i* with the common supply tube 142*c*. The supply manifold 142*m* gathers the individual supply tubes 142*i* in such a manner that the flow channel resistances from the common supply tube 142*c* to the respective individual supply tubes 142*i* are equal to each other. Therefore, in the supply manifold 142*m*, the flow channel between the connecting section of the common supply tube 142*c* and a branching point to the individual supply tubes 142*i* can be regarded as a portion of the common supply tube 142*c*, and the flow channel between the branching point and the connecting section of each individual supply tube 142*i* can be regarded as a portion of each individual supply tube 142*i*. The liquid is supplied from the supply tank 140 through the single common supply tube 142*c*, and is distributed and supplied to the respective individual supply tubes 142*i*, which have the distributary connections with the common supply tube 142*c* in the supply manifold 142*m*.

The recovery tank 144 stores the liquid recovered from the respective head modules 112*m* of the head 112*h*.

The individual recovery tubes 146*i* constitute the recovery flow channel of the liquid, and are connected respectively to the head modules 112*m*, whereby the liquid is recovered and conveyed individually from the head modules 112*m*. One end of each of the individual recovery tubes 146*i* is connected to the recovery port 118 of each head module 112*m*, and the other end thereof is connected to the recovery manifold 146*m*.

The common recovery tube 146*c* constitutes the recovery flow channel of the liquid, and is formed as a single tube, through which the liquid is conveyed to the recovery tank 144. One end of the common recovery tube 146*c* is connected to the recovery manifold 146*m*, and the other end thereof is connected to the recovery tank 144.

The recovery manifold 146*m* gathers and connects the individual recovery tubes 146*i* with the common recovery tube 146*c*. The recovery manifold 146*m* gathers the individual recovery tubes 146*i* in such a manner that the flow channel resistances from the respective individual recovery tubes 146*i* to the common recovery tube 146*c* are equal to each other. Therefore, in the recovery manifold 146*m*, the flow channel between the connecting section of the common recovery tube 146*c* and a joining point of the individual recovery tubes 146*i* can be regarded as a portion of the common recovery tube 146*c*, and the flow channel between the joining point and the connecting section of each individual recovery tube 146*i* can be regarded as a portion of each individual recovery tube 146*i*. The liquid is recovered from the head modules 112*m* of the head 112*h* through the individual recovery tubes 146*i*, which have the tributary connections with the single common recovery tube 146*c* in the recovery manifold 146*m*, and is recovered into the recovery tank 144 through the common recovery tube 146*c*.

Here, in order to apply a negative pressure to the liquid at the nozzle faces, the supply tank 140 is disposed at a position higher than the recovery tank 144 (an upper position in the direction of gravity) or alternatively, the supply tank 140 is disposed at a position lower than the head modules 112*m* of the head 112*h* (a lower position in the direction of gravity). Thus, by means of the hydraulic head differential (H) between the supply tank 140 and the recovery tank 144, the liquid can be supplied continuously to the supply ports 116 of the head modules 112*m* constituting the head 112*h* while applying the negative pressure to the liquid at the nozzle faces, and the liquid can also be recovered continuously from the recovery ports 118 of the head modules 112*m*.

<Tube Layout>

Figure 7:
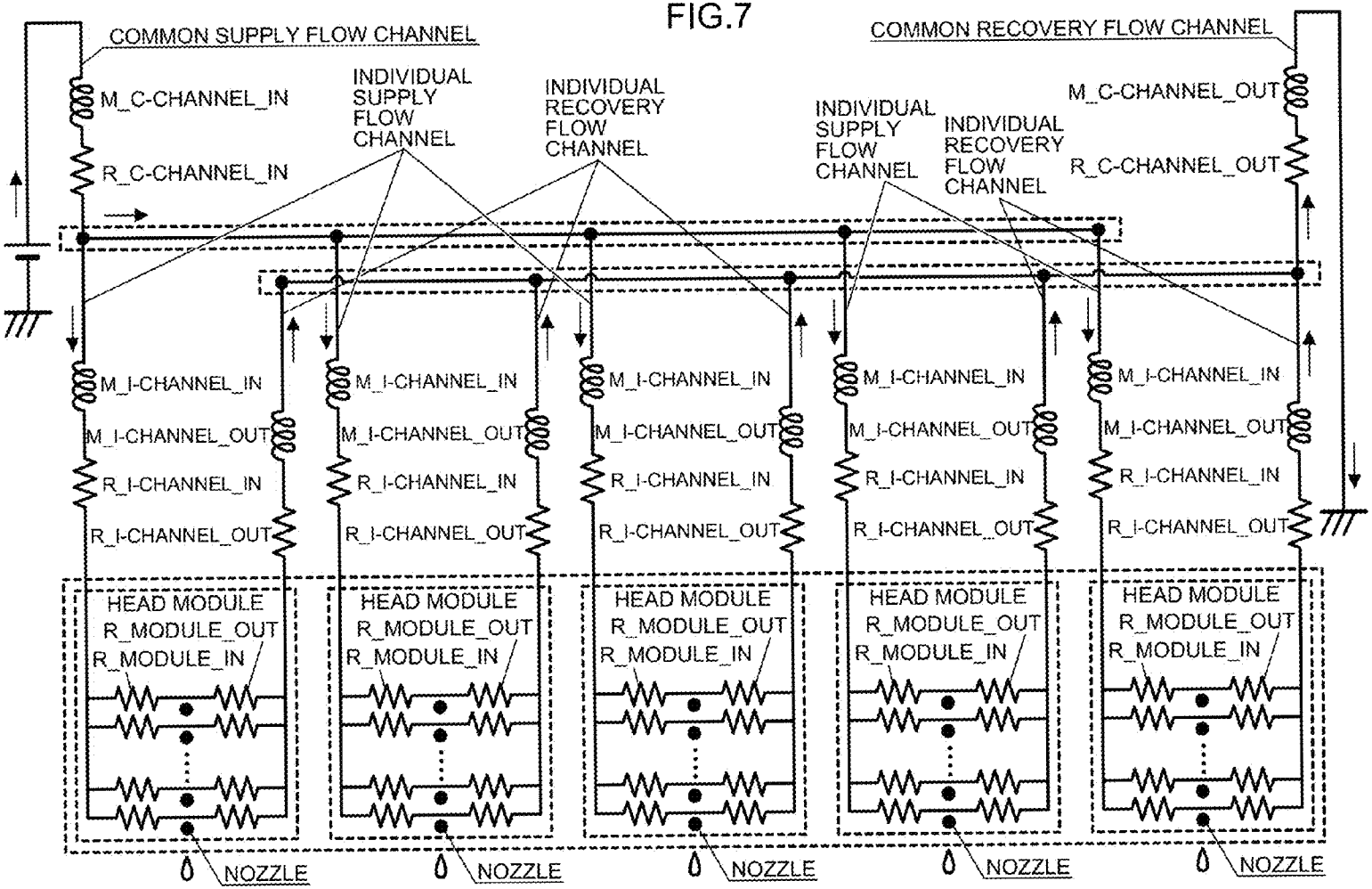
FIG. 7 is a diagram in which the liquid ejection apparatus according to the third embodiment is likened to an electric circuit.

FIG. 7 is a diagram in which the liquid ejection apparatus 100 according to the present embodiment is likened to an electric circuit. In FIG. 7, with respect to the flow channels inside the head modules 112*m*, only the resistance components thereof are depicted and the inertance components thereof are not depicted so as to simplify the drawing.

As described above, the head 112*h* in the liquid ejection apparatus 100 according to the present embodiment is constituted by joining together the plurality of head modules 112*m*.

In this case, the common supply tube 142*c*, the individual supply tubes 142*i*, the common recovery tube 146*c* and the individual recovery tubes 146*i* are laid out on the basis of the ratio between the flow channel resistances of the supply flow channels inside the head modules 112*m* and the flow channel resistances of the recovery flow channels inside the head modules 112*m*.

More specifically, whether the variation in the flow rate due to the ejection of droplets of the liquid is transmitted more readily to the supply side tube or the recovery side tube is governed by the ratio between the flow channel resistance of the supply flow channel inside each head module 112*m* (i.e., the flow channel resistance from the supply port 116 of the head module 112*m* to the nozzles of the head module 112*m*) and the flow channel resistance of the recovery flow channel inside each head module 112*m* (i.e., the flow channel resistance from the nozzles of the head module 112*m* to the recovery port 118 of the head module 112*m*).

Here, the flow channel resistance of the supply flow channel inside each head module 112*m* (the flow channel resistance from the supply port 116 of the head module 112*m* to the nozzles of the head module 112*m*) is referred to as R_MODULE_IN, the flow channel resistance of the recovery flow channel inside each head module 112*m* (the flow channel resistance from the nozzles of the head module 112*m* to the recovery port 118 of the head module 112*m*) is referred to as R_MODULE_OUT, the flow channel resistance of each of the individual supply tubes 142*i* is referred to as R_I-CHANNEL_IN, the flow channel resistance of each of the individual recovery tubes 146*i* is referred to as R_I-CHANNEL_OUT, the flow channel resistance of the common supply tube 142*c* is referred to as R_C-CHANNEL_IN, and the flow channel resistance of the common recovery tube 146*c* is referred to as R_C-CHANNEL_OUT.

If the flow channel resistance of the supply flow channel inside the head module 112*m* (R_MODULE_IN) is greater than the flow channel resistance of the recovery flow channel inside the head module 112*m* (R_MODULE_OUT), i.e., if R_MODULE_IN>R_MODULE_OUT, then the variation in the flow rate is readily transmitted to the side of the individual recovery tube 146*i*.

Conversely, if the flow channel resistance of the recovery flow channel inside the head module 112*m* (R_MODULE_OUT) is greater than the flow channel resistance of the supply flow channel inside the head module 112*m* (R_MODULE_IN), i.e., if R_MODULE_IN<R_MODULE_OUT, then the variation in the flow rate is readily transmitted to the side of the individual supply tube 142*i*.

In the case where the liquid ejection head is configured by joining together the plurality of head modules 112*m*, as in the head 112*h* according to the present embodiment, the pressure variation in each of the common supply tube 142*c* and the common recovery tube 146*c* is the sum of the variations caused by the respective head modules 112*m*. For example, if a liquid ejection head is constituted of five head modules, then when the five head modules are simultaneously driven, the pressure variation in each of the common supply tube 142*c* and the common recovery tube 146*c* is about 5 times greater than the pressure variation in a single head. Consequently, in order to reduce the pressure variation, it is an important approach to compose the common supply tube and the common recovery tube in accordance with the ratio between the flow channel resistance of the supply flow channels inside the head modules and the flow channel resistance of the recovery flow channels inside the head modules.

Therefore, if the flow channel resistance of the supply flow channel inside the head module 112*m* (R_MODULE_IN) is greater than the flow channel resistance of the recovery flow channel inside the head module 112*m* (R_MODULE_OUT), i.e., if R_MODULE_IN>R_MODULE_OUT, then the common supply tube 142*c* and the common recovery tube 146*c* are laid out in such a manner that the flow channel resistance of the common supply tube 142*c* (R_C-CHANNEL_IN) is greater than the flow channel resistance of the common recovery tube 146*c* (R_C-CHANNEL_OUT), i.e., so as to satisfy the condition of R_C-CHANNEL_IN>R_C-CHANNEL_OUT, and moreover, the individual supply tube 142*i* and the individual recovery tube 146*i* are laid out in such a manner that the flow channel resistance of the individual supply tube 142*i* (R_I-CHANNEL_IN) is greater than the flow channel resistance of the individual recovery tube 146*i* (R_I-CHANNEL_OUT), i.e., so as to satisfy the condition of R_I-CHANNEL_IN>R_I-CHANNEL_OUT.

Conversely, if the flow channel resistance of the recovery flow channel inside the head module 112*m* (R_MODULE_OUT) is greater than the flow channel resistance of the supply flow channel inside the head module 112*m* (R_MODULE_IN), i.e., if R_MODULE_IN<R_MODULE_OUT, then the common supply tube 142*c* and the common recovery tube 146*c* are laid out in such a manner that the flow channel resistance of the common recovery tube 146*c* (R_C-CHANNEL_OUT) is greater than the flow channel resistance of the common supply tube 142*c* (R_C-CHANNEL_IN), i.e., so as to satisfy the condition of R_C-CHANNEL_IN<R_C-CHANNEL_OUT, and moreover, the individual supply tube 142*i* and the individual recovery tube 146*i* are laid out in such a manner that the flow channel resistance of the individual recovery tube 146*i* (R_I-CHANNEL_OUT) is greater than the flow channel resistance of the individual supply tube 142*i* (R_I-CHANNEL_IN), i.e., so as to satisfy the condition of R_I-CHANNEL_IN<R_I-CHANNEL_OUT.

In this way, the common supply tube 142*c*, the individual supply tubes 142*i*, the common recovery tube 146*c* and the individual recovery tubes 146*i* are laid out on the basis of the flow channel resistance of the supply flow channels inside the head modules 112*m* and the flow channel resistance of the recovery flow channels inside the head modules 112*m* so as to lower the flow channel resistance of the flow channel on the side suffering a larger variation in the flow rate. Consequently, it is possible to effectively suppress variation in the pressure generated as a result of ejection of droplets from the nozzles.

In particular, in the case of a long head formed by joining together a plurality of head modules 112*m*, as in the head 112*h* according to the present embodiment, since the amount of the droplets simultaneously ejected is large and pressure variation is liable to occur as a result of the ejection, then the present embodiment has an effective action in such cases.

In the present embodiment, all of the common supply tube 142*c*, the individual supply tubes 142*i*, the common recovery tube 146*c* and the individual recovery tubes 146*i* are laid out on the basis of the flow channel resistances inside the respective head modules 112*m*; however, it is also possible to lay out the individual supply tubes 142*i* and the individual recovery tubes 146*i* under the same conditions and to lay out only the common supply tube 142*c* and the common recovery tube 146*c* on the basis of the flow channel resistances inside the respective head modules 112*m*. More specifically, the individual supply tubes 142*i* and the individual recovery tubes 146*i* are fundamentally laid out under the same conditions, and only in a case where there is pressure variation which cannot be ignored in one of the head modules, the individual supply tube 142*i* and the individual recovery tube 146*i* for the one of the head modules are also laid out on the basis of the flow channel resistances inside the one of the head modules.

Therefore, in this case, if the flow channel resistance of the supply flow channel inside the head module 112*m* (R_MODULE_IN) is greater than the flow channel resistance of the recovery flow channel inside the head module 112*m* (R_MODULE_OUT), i.e., if R_MODULE_IN>R_MODULE_OUT, then the common supply tube 142*c* and the common recovery tube 146*c* are laid out in such a manner that the flow channel resistance of the common supply tube 142*c* (R_C-CHANNEL_IN) is greater than the flow channel resistance of the common recovery tube 146*c* (R_C-CHANNEL_OUT), i.e., so as to satisfy the condition of R_C-CHANNEL_IN>R_C-CHANNEL_OUT.

Conversely, if the flow channel resistance of the recovery flow channel inside the head module 112*m* (R_MODULE_OUT) is greater than the flow channel resistance of the supply flow channel inside the head module 112*m* (R_MODULE_IN), i.e., if R_MODULE_IN<R_MODULE_OUT, then the common supply tube 142*c* and the common recovery tube 146*c* are laid out in such a manner that the flow channel resistance of the common recovery tube 146*c* (R_C-CHANNEL_OUT) is greater than the flow channel resistance of the common supply tube 142*c* (R_C-CHANNEL_IN), i.e., so as to satisfy the condition of R_C-CHANNEL_IN<R_C-CHANNEL_OUT.

Similarly to the liquid ejection apparatus 10 in the first embodiment described above, the above-specified condition of the flow channel resistances can be satisfied by appropriately selecting the lengths and diameters of the respective tubes: the common supply tube 142*c*, the individual supply tubes 142*i*, the common recovery tube 146*c* and the individual recovery tubes 146*i*.

Moreover, it is also possible to satisfy the above-specified condition by arranging a filter (filtering device) or a deaeration pump (deaeration device) or the like, which has a high resistance, in the flow channel on the side suffering a smaller variation in the flow rate. For example, if the flow channel resistance of the supply flow channel inside the head module 112*m* (R_MODULE_IN) is greater than the flow channel resistance of the recovery flow channel inside the head module 112*m* (R_MODULE_OUT), i.e., if R_MODULE_IN>R_MODULE_OUT, then it is possible to satisfy the above-specified condition by arranging the filter (filtering device) or the deaeration pump (deaeration device) on the side of the common supply tube 142*c*. Conversely, if the flow channel resistance of the recovery flow channel inside the head module 112*m* (R_MODULE_OUT) is greater than the flow channel resistance of the supply flow channel inside the head module 112*m* (R_MODULE_IN), i.e., if R_MODULE_IN<R_MODULE_OUT, then it is possible to satisfy the above-specified condition by arranging the filter (filtering device) or the deaeration pump (deaeration device) on the side of the common recovery tube 146*c*.

Furthermore, the description given above relates to the method of laying out the tubes on the supply side and the tubes on the recovery side on the basis of the flow channel resistances; however, similarly to the case of the first embodiment described above, it is also possible to lay out the tubes on the supply side and the tubes on the recovery side on the basis of the inertances.

Here, the inertance of the supply flow channel inside each head module 112*m* (the inertance from the supply port 116 of the head module 112*m* to the nozzles of the head module 112*m*) is referred to as M_MODULE_IN, the inertance of the recovery flow channel inside each head module 112*m* (the inertance from the nozzles of the head module 112*m* to the recovery port 118 of the head module 112*m*) is referred to as M_MODULE_OUT, the inertance of each of the individual supply tubes 142*i* is referred to as M_I-CHANNEL_IN, the inertance of each of the individual recovery tubes 146*i* is referred to as M_I-CHANNEL_OUT, the inertance of the common supply tube 142*c* is referred to as M_C-CHANNEL_IN, and the inertance of the common recovery tube 146*c* is referred to as M_C-CHANNEL_OUT.

If the inertance of the supply flow channel inside the head module 112*m* (M_MODULE_IN) is greater than the inertance of the recovery flow channel inside the head module 112*m* (M_MODULE_OUT), i.e., if M_MODULE_IN>M_MODULE_OUT, then the tubes of the individual supply tube 142*i*, the common supply tube 142*c*, the individual recovery tube 146*i* and the common recovery tube 146*c* are laid out in such a manner that the inertance of the common supply tube 142*c* (M_C-CHANNEL_IN) is greater than the inertance of the common recovery tube 146*c* (M_C-CHANNEL_OUT), and the inertance of the individual supply tube 142*i* (M_I-CHANNEL_IN) is greater than the inertance of the individual recovery tube 146*i* (M_I-CHANNEL_OUT), i.e., so as to satisfy the conditions of: M_C-CHANNEL_IN>M_C-CHANNEL_OUT; and M_I-CHANNEL_IN>M_I-CHANNEL_OUT.

Conversely, if the inertance of the recovery flow channel inside the head module 112*m* (M_MODULE_OUT) is greater than the inertance of the supply flow channel inside the head module 112*m* (M_MODULE_IN), i.e., if M_MODULE_IN<M_MODULE_OUT, then the tubes of the individual supply tube 142*i*, the common supply tube 142*c*, the individual recovery tube 146*i* and the common recovery tube 146*c* are laid out in such a manner that the inertance of the common recovery tube 146*c* (M_C-CHANNEL_OUT) is greater than the inertance of the common supply tube 142*c* (M_C-CHANNEL_IN), and the inertance of the individual recovery tube 146*i* (M_I-CHANNEL_OUT) is greater than the inertance of the individual supply tube 142*i* (M_I-CHANNEL_IN), i.e., so as to satisfy the conditions of: M_C-CHANNEL_IN<M_C-CHANNEL_OUT; and M_I-CHANNEL_IN<M_I-CHANNEL_OUT.

Similarly to the case based on the flow channel resistances, it is also possible to lay out the individual supply tubes 142*i* and the individual recovery tubes 146*i* under the same conditions and to lay out only the common supply tube 142*c* and the common recovery tube 146*c* on the basis of the inertances inside the respective head modules 112*m*. More specifically, the individual supply tubes 142*i* and the individual recovery tubes 146*i* are fundamentally laid out under the same conditions, and only in a case where there is pressure variation which cannot be ignored in one of the head modules, the individual supply tube 142*i* and the individual recovery tube 146*i* for the one of the head modules are also laid out on the basis of the inertances inside the one of the head modules.

Therefore, in this case, if the inertance of the supply flow channel inside the head module 112*m* (M_MODULE_IN) is greater than the inertance of the recovery flow channel inside the head module 112*m* (M_MODULE_OUT), i.e., if M_MODULE_IN>M_MODULE_OUT, then the common supply tube 142*c* and the common recovery tube 146*c* are laid out in such a manner that the inertance of the common supply tube 142*c* (M_C-CHANNEL_IN) is greater than the inertance of the common recovery tube 146*c* (M_C-CHANNEL_OUT), i.e., so as to satisfy the condition of M_C-CHANNEL_IN>M_C-CHANNEL_OUT.

Conversely, if the inertance of the recovery flow channel inside the head module 112*m* (M_MODULE_OUT) is greater than the inertance of the supply flow channel inside the head module 112*m* (M_MODULE_IN), i.e., if M_MODULE_IN<M_MODULE_OUT, then the common supply tube 142*c* and the common recovery tube 146*c* are laid out in such a manner that the inertance of the common recovery tube 146*c* (M_C-CHANNEL_OUT) is greater than the inertance of the common supply tube 142*c* (M_C-CHANNEL_IN), i.e., so as to satisfy the condition of M_C-CHANNEL_IN<M_C-CHANNEL_OUT.

In the liquid ejection apparatus 100 according to the present embodiment, it is thus possible to effectively suppress the occurrence of pressure variation by laying out the tubes of the individual supply tubes 142*i*, the common supply tube 142*c*, the individual recovery tubes 146*i* and the common recovery tube 146*c* on the basis of the ratio between the flow channel resistance (or the inertance) of the supply flow channel inside the head 112*h* and the flow channel resistance (or the inertance) of the recovery flow channel inside the head 112*h*. Consequently, it is possible to supply the liquid to be ejected from the nozzles, to the head 112*h* stably, and the ejection of droplets of the liquid from the nozzles can be controlled accurately.

The flow channel resistance of the supply flow channel inside the head module 112*m* (R_MODULE_IN) is the combined flow channel resistance of all of the flow channels which constitute the supply flow channel, and the flow channel resistance of the recovery flow channel inside the head module 112*m* (R_MODULE_OUT) is the combined flow channel resistance of all of the flow channels which constitute the recovery flow channel.

The flow channel resistance of the supply flow channel inside the head module is governed principally by the individual supply flow channels inside the head module, and the flow channel resistance of the recovery flow channel is governed principally by the individual recovery flow channels inside the head module. Therefore, the combined flow channel resistance of the internal individual supply flow channels can be taken as the flow channel resistance of the supply flow channel (R_MODULE_IN), and the combined flow channel resistance of the internal individual recovery flow channels can be taken as the flow channel resistance of the recovery flow channel (R_MODULE_OUT), which correspond respectively to R_MODULE_IN and R_MODULE_OUT shown in FIG. 7.

As shown in FIG. 7, if the flow channels having the same flow channel resistances are arranged in parallel, then when these flow channels are considered together, they exhibit combined flow channel resistances similar to the electric resistances (i.e., 1/R_in_total=1/R_head_in1+1/R_head_in2+ . . . , 1/R_out_total=1/R_head_out1, 1/R_head_ out2+ . . . ). Consequently, the ratio between the combined flow channel resistance of the individual supply flow channels inside the head module and the combined flow channel resistance of the individual recovery flow channels inside the head module (the ratio between R_MODULE_IN and R_MODULE_OUT in FIG. 7) governs the ratio between the flow channel resistance of the supply flow channel inside the head module and the flow channel resistance of the recovery flow channel inside the head module.

Consequently, if there is no variation in the flow channel resistance between the respective nozzles, then the ratio between the flow channel resistance of the internal individual supply flow channel 32 and the flow channel resistance of the internal individual recovery flow channel 36 (the ratio between R_MODULE_IN and R_MODULE_OUT in FIG. 7) directly governs the ratio between the overall flow channel resistances on the supply side and the recovery side.

If there is variation in the flow channel resistance between the nozzles, then it is possible to determine the overall flow channel resistance by calculating the combined flow channel resistance of the flow channels arranged in parallel.

The same applies to the inertances of the supply flow channels inside the head module and the inertances of the recovery flow channels inside the head module.

Fourth Embodiment

Figure 8:
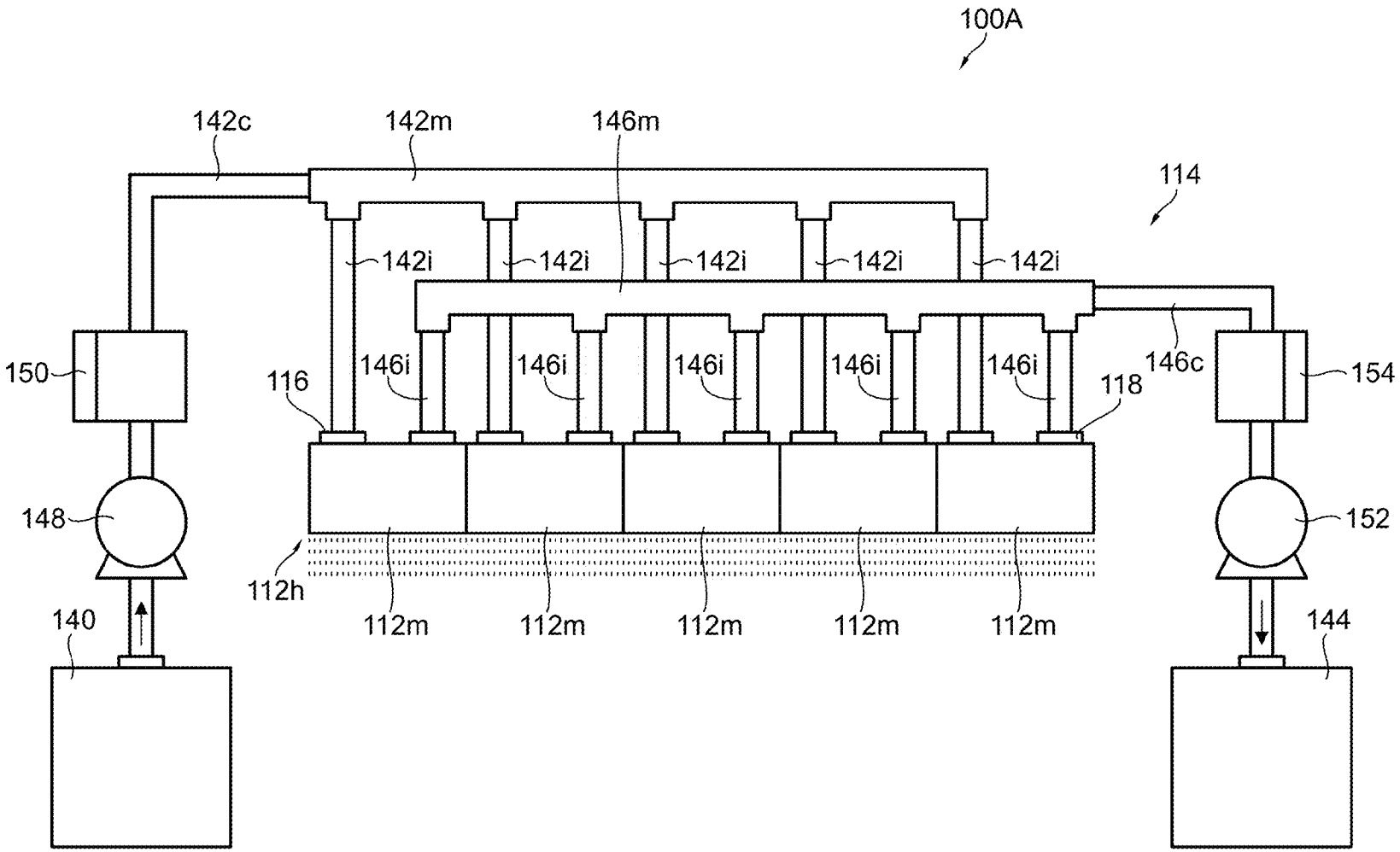
FIG. 8 is a schematic drawing of a liquid ejection apparatus according to a fourth embodiment of the present invention.

FIG. 8 is a schematic drawing of a liquid ejection apparatus 100A according to a fourth embodiment of the present invention.

As shown in FIG. 8, the liquid ejection apparatus 100A according to the present embodiment carries out the supply and recovery of the liquid by means of pumps. The composition of the head 112*h* is the same as the liquid ejection apparatus 100 according to the third embodiment described above, and therefore only the composition of the liquid supply and recovery unit 114 for carrying out the supply and recovery of the liquid to and from the head 112*h* constituted of the head modules 112*m* is described here.

<Liquid Supply and Recovery Unit>

As shown in FIG. 8, the liquid supply and recovery unit 114 includes: a supply tank 140; a common supply tube 142*c*; individual supply tubes 142*i*; a supply manifold 142*m*, which connects the common supply tube 142*c* to the individual supply tubes 142*i*; a recovery tank 144; individual recovery tubes 146*i*; a common recovery tube 146*c*; a recovery manifold 146*m*, which connects the individual recovery tubes 146*i* to the common recovery tube 146*c*; a supply pump 148, which conveys the liquid contained in the supply tank 140 to the head 112*h*; a supply damper 150, which is arranged in the common supply tube 142*c*; a recovery pump 152, which conveys the liquid from the head 112*h* to the recovery tank 144; and a recovery damper 154, which is arranged in the common recovery tube 146*c*.

The supply tank 140 stores the liquid to be supplied to the head 112*h*.

The individual supply tubes 142*i* are connected respectively to the head modules 112*m*, whereby the liquid is conveyed individually to the respective head modules 112*m*. One end of each of the individual supply tubes 142*i* is connected to the supply manifold 142*m*, and the other end thereof is connected to the supply port 116 of each head module 112*m*.

The common supply tube 142*c* is formed as a single tube, through which the liquid is conveyed from the supply tank 140. One end of the common supply tube 142*c* is connected to the supply tank 140, and the other end thereof is connected to the supply manifold 142*m*.

The supply manifold 142*m* gathers and connects the individual supply tubes 142*i* with the common supply tube 142*c*. The supply manifold 142*m* gathers the individual supply tubes 142*i* in such a manner that the flow channel resistances from the common supply tube 142*c* to the respective individual supply tubes 142*i* are equal to each other. The liquid is supplied from the supply tank 140 through the single common supply tube 142*c*, and is distributed and supplied to the respective individual supply tubes 142*i*, which have the distributary connections with the common supply tube 142*c* in the supply manifold 142*m*.

The recovery tank 144 stores the liquid recovered from the respective head modules 112*m* of the head 112*h*.

The individual recovery tubes 146*i* are connected respectively to the head modules 112*m*, whereby the liquid is recovered and conveyed individually from the head modules 112*m*. One end of each of the individual recovery tubes 146*i* is connected to the recovery port 118 of each head module 112*m*, and the other end thereof is connected to the recovery manifold 146*m*.

The common recovery tube 146*c* is formed as a single tube, through which the liquid is conveyed to the recovery tank 144. One end of the common recovery tube 146*c* is connected to the recovery manifold 146*m*, and the other end thereof is connected to the recovery tank 144.

The recovery manifold 146*m* gathers and connects the individual recovery tubes 146*i* with the common recovery tube 146*c*. The recovery manifold 146*m* gathers the individual recovery tubes 146*i* in such a manner that the flow channel resistances from the respective individual recovery tubes 146*i* to the common recovery tube 146*c* are equal to each other. The liquid is recovered from the head modules 112*m* of the head 112*h* through the individual recovery tubes 146*i*, which have the tributary connections with the single common recovery tube 146*c* in the recovery manifold 146*m*, and is recovered into the recovery tank 144 through the common recovery tube 146*c*.

The supply pump 148 is disposed at an intermediate point of the common supply tube 142*c*. The supply pump 148 conveys the liquid contained in the supply tank 140, to the respective head modules 112*m* of the head 112*h* through the common supply tube 142*c*. The supply pump 148 is constituted of a tube pump, for example.

The supply damper 150 is disposed at an intermediate point of the common supply tube 142*c*. The supply damper 150 principally absorbs pressure variation (pulsation) of the liquid that occurs as a result of the driving of the supply pump 148. Therefore, the supply damper 150 is disposed between the supply pump 148 and the head 112*h*.

The recovery pump 152 is disposed at an intermediate point of the common recovery tube 146*c*. The recovery pump 152 conveys the liquid from the respective head modules 112*m* of the head 112*h* to the recovery tank 144 through the common recovery tube 146*c*. The recovery pump 152 is constituted of a tube pump, for example.

The recovery dumper 154 is disposed at an intermediate point of the common recovery tube 146*c*. The recovery damper 154 principally absorbs pressure variation (pulsation) of the liquid that occurs as a result of the driving of the recovery pump 152. Therefore, the recovery damper 154 is disposed between the head 112*h* and the recovery pump 152.

When the supply pump 148 and the recovery pump 152 are driven, the liquid is supplied continuously from the supply tank 140 to the head modules 112*m* of the head 112*h*, and the liquid is also recovered continuously from the head modules 112*m* of the head 112*h* to the recovery tank 144. In so doing, the supply pump 148 and the recovery pump 152 are driven and the liquid is supplied to and recovered from the head 112*h*, in such a manner that a negative pressure is applied to the liquid at the nozzle faces.

<Tube Layout>

In the liquid ejection apparatus 100A according to the present embodiment also, the individual supply tubes 142*i*, the common supply tube 142*c*, the individual recovery tubes 146*i* and the common recovery tube 146*c* are laid out on the basis of the ratio between the flow channel resistances of the supply flow channels inside the head modules 112*m* and the flow channel resistances of the recovery flow channels inside the head modules 112*m*.

More specifically, if the flow channel resistance of the supply flow channel inside the head module 112*m* (R_MODULE_IN) is greater than the flow channel resistance of the recovery flow channel inside the head module 112*m* (R_MODULE_OUT), i.e., if R_MODULE_IN>R_MODULE_OUT, then the common supply tube 142*c* and the common recovery tube 146*c* are laid out in such a manner that the flow channel resistance of the common supply tube 142*c* (R_C-CHANNEL_IN) is greater than the flow channel resistance of the common recovery tube 146*c* (R_C-CHANNEL_OUT), i.e., so as to satisfy the condition of R_C-CHANNEL_IN>R_C-CHANNEL_OUT, and moreover, the individual supply tube 142*i* and the individual recovery tube 146*i* are laid out in such a manner that the flow channel resistance of the individual supply tube 142*i* (R_I-CHANNEL_IN) is greater than the flow channel resistance of the individual recovery tube 146*i* (R_I-CHANNEL_OUT), i.e., so as to satisfy the condition of R_I-CHANNEL_IN>R_I-CHANNEL_OUT.

Conversely, if the flow channel resistance of the recovery flow channel inside the head module 112*m* (R_MODULE_OUT) is greater than the flow channel resistance of the supply flow channel inside the head module 112*m* (R_MODULE_IN), i.e., if R_MODULE_IN<R_MODULE_OUT, then the common supply tube 142*c* and the common recovery tube 146*c* are laid out in such a manner that the flow channel resistance of the common recovery tube 146*c* (R_C-CHANNEL_OUT) is greater than the flow channel resistance of the common supply tube 142*c* (R_C-CHANNEL_IN), i.e., so as to satisfy the condition of R_C-CHANNEL_IN<R_C-CHANNEL_OUT, and moreover, the individual supply tube 142*i* and the individual recovery tube 146*i* are laid out in such a manner that the flow channel resistance of the individual recovery tube 146*i* (R_I-CHANNEL_OUT) is greater than the flow channel resistance of the individual supply tube 142*i* (R_I-CHANNEL_IN), i.e., so as to satisfy the condition of R_I-CHANNEL_IN<R_I-CHANNEL_OUT.

Furthermore, similarly to the third embodiment described above, it is also possible to lay out the individual supply tubes 142*i* and the individual recovery tubes 146*i* under the same conditions and to lay out only the common supply tube 142*c* and the common recovery tube 146*c* on the basis of the flow channel resistances inside the respective head modules 112*m*. More specifically, the individual supply tubes 142*i* and the individual recovery tubes 146*i* are fundamentally laid out under the same conditions, and only in a case where there is pressure variation which cannot be ignored in one of the head modules, the individual supply tube 142*i* and the individual recovery tube 146*i* for the one of the head modules are also laid out on the basis of the flow channel resistances inside the one of the head modules.

Therefore, in this case, if the flow channel resistance of the supply flow channel inside the head module 112*m* (R_MODULE_IN) is greater than the flow channel resistance of the recovery flow channel inside the head module 112*m* (R_MODULE_OUT), i.e., if R_MODULE_IN>R_MODULE_OUT, then the common supply tube 142*c* and the common recovery tube 146*c* are laid out in such a manner that the flow channel resistance of the common supply tube 142*c* (R_C-CHANNEL_IN) is greater than the flow channel resistance of the common recovery tube 146*c* (R_C-CHANNEL_OUT), i.e., so as to satisfy the condition of R_C-CHANNEL_IN>R_C-CHANNEL_OUT.

Conversely, if the flow channel resistance of the recovery flow channel inside the head module 112*m* (R_MODULE_OUT) is greater than the flow channel resistance of the supply flow channel inside the head module 112*m* (R_MODULE_IN), i.e., if R_MODULE_IN<R_MODULE_OUT, then the common supply tube 142*c* and the common recovery tube 146*c* are laid out in such a manner that the flow channel resistance of the common recovery tube 146*c* (R_C-CHANNEL_OUT) is greater than the flow channel resistance of the common supply tube 142*c* (R_C-CHANNEL_IN), i.e., so as to satisfy the condition of R_C-CHANNEL_IN<R_C-CHANNEL_OUT.

In the case of the present embodiment, the supply damper 150 is arranged in the common supply tube 142*c*, and the recovery damper 154 is arranged in the common recovery tube 146*c*. In this case, the common supply tube 142*c* is laid out in such a manner that the region between the supply damper 150 and the supply manifold 142*m* satisfies the above-specified condition, and the common recovery tube 146*c* is laid out in such a manner that the region between the recovery manifold 146*m* and the recovery damper 154 satisfies the above-specified condition.

In this way, in the cases where the liquid is supplied to and recovered from the head modules 112*m* constituting the head 112*h* by means of the pumps also, the tubes on the supply side and the tubes on the recovery side are laid out on the basis of the flow channel resistance of the supply flow channels inside the head modules and the flow channel resistance of the recovery flow channels inside the head modules. Consequently, it is possible to effectively suppress variation in the pressure generated as a result of ejection of droplets from the nozzles.

Similarly to the case of the first embodiment described above, the layout method involves adjusting the lengths and diameters of the tubes on the supply side and the tubes on the recovery side, for example. Furthermore, the layout method can also involve arranging a filter (filtering device) or a deaeration pump (deaeration device) or the like, which has a high resistance, in the flow channel on the side suffering a smaller variation in the flow rate.

Moreover, the description given above relates to the method of laying out the tubes on the supply side and the tubes on the recovery side on the basis of the flow channel resistances; however, similarly to the case of the first embodiment described above, it is also possible to lay out the tubes on the supply side and the tubes on the recovery side on the basis of the inertances.

More specifically, in this case, the inertance of the supply flow channel inside the head module 112*m* (M_MODULE_IN) is greater than the inertance of the recovery flow channel inside the head module 112*m* (M_MODULE_OUT), i.e., if M_MODULE_IN>M_MODULE_OUT, then the common supply tube 142*c* and the common recovery tube 146*c* are laid out in such a manner that t the inertance of the common supply tube 142*c* (M_C-CHANNEL_IN) is greater than the inertance of the common recovery tube 146*c* (M_C-CHANNEL_OUT), i.e., so as to satisfy the condition of M_C-CHANNEL_IN>M_C-CHANNEL_OUT, and moreover, the individual supply tube 142*i* and the individual recovery tube 146*i* are laid out in such a manner that the inertance of the individual supply tube 142*i* (M_I-CHANNEL_IN) is greater than the inertance of the individual recovery tube 146*i* (M_I-CHANNEL_OUT), i.e., so as to satisfy the condition of M_I-CHANNEL_IN>M_I-CHANNEL_OUT.

Conversely, if the inertance of the recovery flow channel inside the head module 112*m* (M_MODULE_OUT) is greater than the inertance of the supply flow channel inside the head module 112*m* (M_MODULE_IN), i.e., if M_MODULE_IN<M_MODULE_OUT, then the common supply tube 142*c* and the common recovery tube 146*c* are laid out in such a manner that the inertance of the common recovery tube 146*c* (M_C-CHANNEL_OUT) is greater than the inertance of the common supply tube 142*c* (M_C-CHANNEL_IN), i.e., so as to satisfy the condition of M_C-CHANNEL_IN<M_C-CHANNEL_OUT, and moreover, the individual supply tube 142*i* and the individual recovery tube 146*i* are laid out in such a manner that the inertance of the individual recovery tube 146*i* (M_I-CHANNEL_OUT) is greater than the inertance of the individual supply tube 142*i* (M_I-CHANNEL_IN), i.e., so as to satisfy the condition of M_I-CHANNEL_IN<M_I-CHANNEL_OUT.

Similarly to the case based on the flow channel resistances, it is also possible to lay out the individual supply tubes 142*i* and the individual recovery tubes 146*i* under the same conditions and to lay out only the common supply tube 142*c* and the common recovery tube 146*c* on the basis of the inertances inside the respective head modules 112*m*. More specifically, the individual supply tubes 142*i* and the individual recovery tubes 146*i* are fundamentally laid out under the same conditions, and only in a case where there is pressure variation which cannot be ignored in one of the head modules, the individual supply tube 142*i* and the individual recovery tube 146*i* for the one of the head modules are also laid out on the basis of the inertances inside the one of the head modules.

Therefore, in this case, if the inertance of the supply flow channel inside the head module 112*m* (M_MODULE_IN) is greater than the inertance of the recovery flow channel inside the head module 112*m* (M_MODULE_OUT), i.e., if M_MODULE_IN>M_MODULE_OUT, then the common supply tube 142*c* and the common recovery tube 146*c* are laid out in such a manner that the inertance of the common supply tube 142*c* (M_C-CHANNEL_IN) is greater than the inertance of the common recovery tube 146*c* (M_C-CHANNEL_OUT), i.e., so as to satisfy the condition of M_C-CHANNEL_IN>M_C-CHANNEL_OUT.

Conversely, if the inertance of the recovery flow channel inside the head module 112*m* (M_MODULE_OUT) is greater than the inertance of the supply flow channel inside the head module 112*m* (M_MODULE_IN), i.e., if M_MODULE_IN<M_MODULE_OUT, then the common supply tube 142*c* and the common recovery tube 146*c* are laid out in such a manner that the inertance of the common recovery tube 146*c* (M_C-CHANNEL_OUT) is greater than the inertance of the common supply tube 142*c* (M_C-CHANNEL_IN), i.e., so as to satisfy the condition of M_C-CHANNEL_IN<M_C-CHANNEL_OUT.

Although the supply damper 150 and the recovery damper 154 are disposed in the common supply tube 142*c* and the common recovery tube 146*c* in the present embodiment, these dampers do not necessarily have to be arranged. If the supply damper 150 and the recovery damper 154 are not arranged, then the common supply tube 142*c* is laid out in such a manner that the region between the supply pump 148 and the supply manifold 142*m* satisfies the above-specified condition, and the common recovery tube 146*c* is laid out in such a manner that the region between the recovery manifold 146*m* and the recovery pump 152 satisfies the above-specified condition.

Furthermore, the individual supply tubes 142*i* and the individual recovery tubes 146*i* can be provided with dampers. It is thereby possible to suppress pressure variation more effectively.

Further Embodiments

Some heads can be provided with bypass flow channels inside thereof

Figure 9:
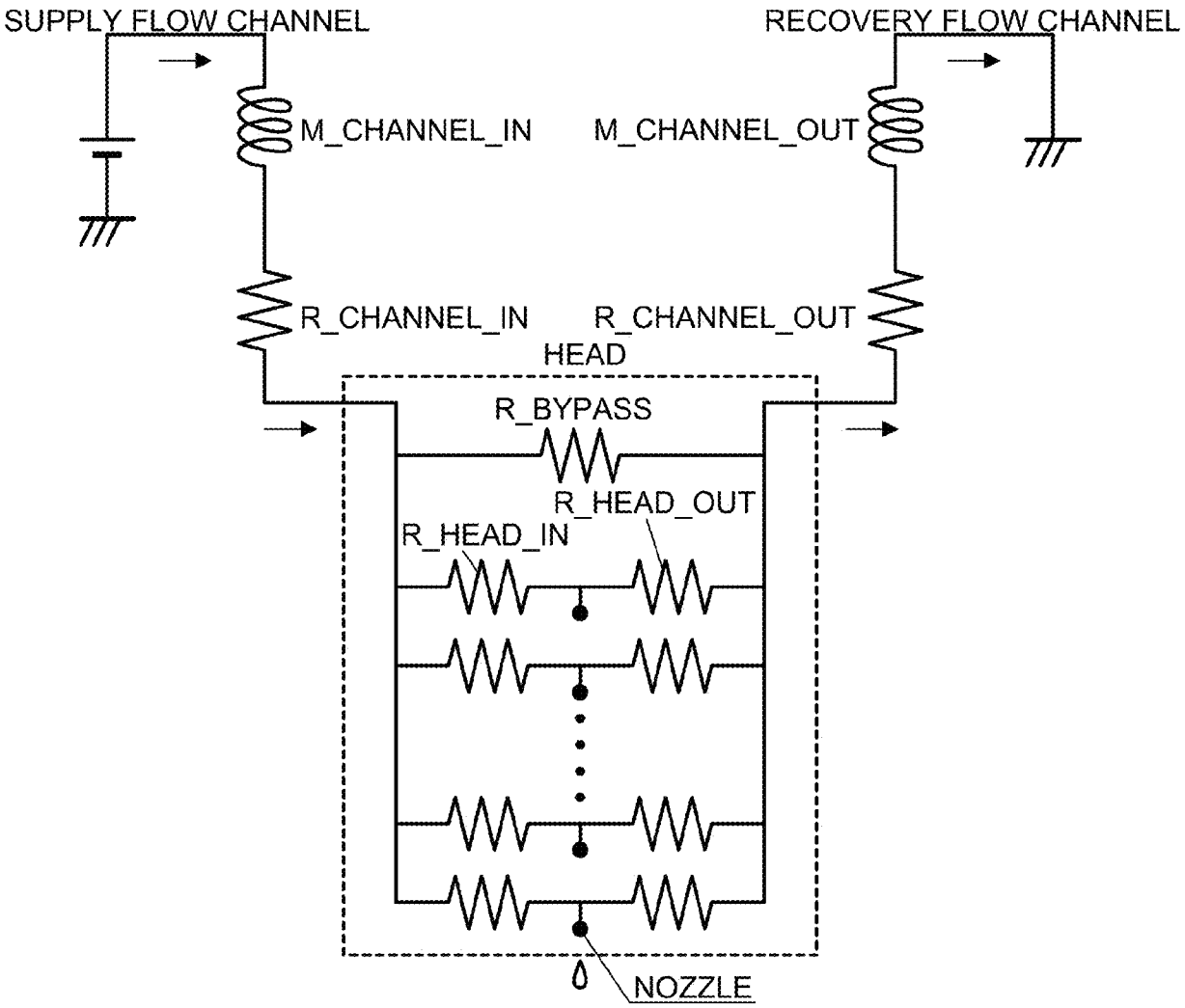
FIG. 9 is a diagram in which a liquid ejection apparatus having a bypass flow channel inside a head is likened to an electric circuit.

FIG. 9 is a diagram in which a liquid ejection apparatus having a bypass flow channel inside the head is likened to an electric circuit, where the head of the liquid ejection apparatus according to the first embodiment has been modified to have the bypass flow channel. In FIG. 9, with respect to the flow channels inside the head, only the resistance components thereof are depicted and the inertance components thereof are not depicted so as to simplify the drawing.

In the head provided with the bypass flow channel inside thereof, if the flow channel resistance of the bypass flow channel (R_BYPASS) is smaller than the flow channel resistance of the supply tube (R_CHANNEL_IN) or the flow channel resistance of the recovery tube (R_CHANNEL_OUT), then the variation components caused by the head is shared equally between the supply side and the recovery side, and there is virtually the same level of variation on the supply side and the recovery side.

Therefore, in the head provided with the bypass flow channel inside thereof, if the flow channel resistance of the bypass flow channel (R_BYPASS) is greater than the flow channel resistance of the supply tube (R_CHANNEL_IN) and the flow channel resistance of the recovery tube (R_CHANNEL_OUT), then the tube layout based on the flow channel resistances (or the inertances) inside the head as described above is effective.

The same applies to a case where a liquid ejection head is configured by joining together a plurality of head modules, and if there is a bypass flow channel inside each head module, and if the flow channel resistance of the bypass flow channel is greater than the flow channel resistance of the supply side tube and the flow channel resistance of the recovery side tube, then the tube layout based on the flow channel resistances (or the inertances) inside the head module is effective.

Although the liquid flows in one direction from the supply tank toward the recovery tank in the above-described embodiments, it is also possible to adopt a composition that is provided with a flow channel to return the liquid recovered in the recovery tank, to the supply tank, so as to circulate the liquid.

Moreover, if the liquid is conveyed by the pump, then it is possible to adopt a composition in which the supply tank and recovery tank are combined.

The above-described embodiments of the present invention are applied to the liquid ejection heads having the nozzles arranged in one row on the nozzle face, but the structure of the head is not limited to this. Apart from this, for example, the present invention can also be applied similarly to a liquid ejection head having a composition in which nozzles are arranged in a matrix configuration on a nozzle face. A liquid ejection head of this kind has a large number of nozzles and the volume of droplets simultaneously ejected is large, which means that the present invention has an especially effective action in such cases.

Moreover, although the above-described embodiments of the present invention are applied to the liquid ejection heads based on a so-called piezoelectric method, the present invention can also be applied similarly to a liquid ejection head based on another drive method, such as a thermal method.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection apparatus, comprising:

a head including: a nozzle which is configured to eject liquid; a supply port to which the liquid is continuously supplied; and a recovery port from which the liquid is continuously recovered;

a supply flow channel through which the liquid is supplied to the head; and a recovery flow channel through which the liquid is recovered from the head, wherein:

a flow channel resistance inside the head from the supply port to the nozzle is R_HEAD_IN, a flow channel resistance inside the head from the nozzle to the recovery port is R_HEAD_OUT, a flow channel resistance of the supply flow channel is R_CHANNEL_IN, and a flow channel resistance of the recovery flow channel is R_CHANNEL_OUT; and when R_HEAD_IN>R_HEAD_OUT, the supply flow channel and the recovery flow channel are adjusted so as to satisfy a condition of R_CHANNEL_IN >R_CHANNEL_OUT.

2. The liquid ejection apparatus as defined in claim 1, wherein the supply flow channel and the recovery flow channel are adjusted while flow channel diameters and flow channel lengths of the supply flow channel and the recovery flow channel are selected so as to satisfy the condition.

3. The liquid ejection apparatus as defined in claim 1, wherein the supply flow channel and the recovery flow channel are adjusted while at least one of the supply flow channel and the recovery flow channel is provided with at least one of a filtering device and a deaeration device so as to satisfy the condition.

4. The liquid ejection apparatus as defined in claim 1, further comprising:

a supply tank to which the supply flow channel is connected; and a recovery tank to which the recovery flow channel is connected, wherein the liquid is supplied to the head by a hydraulic head pressure differential between the supply tank and the recovery tank.

5. The liquid ejection apparatus as defined in claim 1, further comprising:

a supply pump which is configured to convey the liquid to the head through the supply flow channel;

a supply damper which is arranged in the supply flow channel;

a recovery pump which is configured to convey the liquid from the head through the recovery flow channel; and a recovery damper which is arranged in the recovery flow channel.

6. A liquid ejection apparatus, comprising:

a head comprising a plurality of head modules, each of the head modules including: a nozzle which is configured to eject liquid; an individual supply port to which the liquid is continuously supplied; and an individual recovery port from which the liquid is continuously recovered;

a plurality of individual supply flow channels through which the liquid is supplied respectively to the head modules;

a common supply flow channel through which the liquid is supplied to the individual supply flow channels having distributary connections with the common supply flow channel;

a plurality of individual recovery flow channels through which the liquid is recovered respectively from the head modules; and a common recovery flow channel through which the liquid is recovered from the individual recovery flow channels having tributary connections with the common recovery flow channel, wherein:

a flow channel resistance inside each of the head modules from the individual supply port to the nozzle is R_MODULE_IN, a flow channel resistance inside each of the head modules from the nozzle to the individual recovery port is R_MODULE_OUT, a flow channel resistance of the common supply flow channel is R_C-CHANNEL_IN, and a flow channel resistance of the common recovery flow channel is R_C-CHANNEL__OUT;

when R_MODULE_IN>R_MODULE_OUT, the common supply flow channel and the common recovery flow channel are adjusted so as to satisfy a condition of R_C-CHANNEL_IN>R_C-CHANNEL_OUT; and when R_MODULE_IN<R_MODULE_OUT, the common supply flow channel and the common recovery flow channel are adjusted so as to satisfy a condition of R_C-CHANNEL_IN<R_C-CHANNEL_OUT.

7. The liquid ejection apparatus as defined in claim 6, wherein:

a flow channel resistance of each of the individual supply flow channels is R_I-CHANNEL_IN, and a flow channel resistance of each of the individual recovery flow channels is R_I-CHANNEL_OUT;

when R_MODULE_IN>R_MODULE_OUT, the individual supply flow channels, the individual recovery flow channels, the common supply flow channel and the common recovery flow channel are adjusted so as to satisfy conditions of R_I-CHANNEL_IN>R_I-CHANNEL_OUT, and R_C-CHANNEL_IN>R_C-CHANNEL_OUT; and when R_MODULE_IN<R_MODULE_OUT, the individual supply flow channels, the individual recovery flow channels, the common supply flow channel and the common recovery flow channel are adjusted so as to satisfy conditions of R_I-CHANNEL_IN<R_I-CHANNEL_OUT, and R_C-CHANNEL_IN <R_C-CHANNEL_OUT.

8. The liquid ejection apparatus as defined in claim 7, wherein the individual supply flow channels, the individual recovery flow channels, the common supply flow channel and the common recovery flow channel are adjusted while flow channel diameters and flow channel lengths of the individual supply flow channels, the individual recovery flow channels, the common supply flow channel and the common recovery flow channel are selected so as to satisfy the conditions.

9. The liquid ejection apparatus as defined in claim 6, wherein the individual supply flow channels, the individual recovery flow channels, the common supply flow channel and the common recovery flow channel are adjusted while at least one of the individual supply flow channels, the individual recovery flow channels, the common supply flow channel and the common recovery flow channel is provided with at least one of a filtering device and a deaeration device so as to satisfy the conditions.

10. The liquid ejection apparatus as defined in claim 6, further comprising:

a supply tank to which the common supply flow channel is connected; and a recovery tank to which the common recovery flow channel is connected, wherein the liquid is supplied to the head by a hydraulic head pressure differential between the supply tank and the recovery tank.

11. The liquid ejection apparatus as defined in claim 6, further comprising:

a supply pump which is configured to convey the liquid to the head through the common supply flow channel;

a supply damper which is arranged in the common supply flow channel;

a recovery pump which is configured to convey the liquid from the head through the common recovery flow channel; and a recovery damper which is arranged in the common recovery flow channel.

12. A liquid ejection apparatus, comprising:

a head including: a nozzle which is configured to eject liquid; a supply port to which the liquid is continuously supplied; and a recovery port from which the liquid is continuously recovered;

a supply flow channel through which the liquid is supplied to the head; and a recovery flow channel through which the liquid is recovered from the head, wherein:

an inertance inside the head from the supply port to the nozzle is M_HEAD_IN, an inertance inside the head from the nozzle to the recovery port is M_HEAD_OUT, an inertance of the supply flow channel is M_CHANNEL_IN, and an inertance of the recovery flow channel is M_CHANNEL_OUT;

when M_HEAD_IN>M_HEAD_OUT, the supply flow channel and the recovery flow channel are adjusted so as to satisfy a condition of M_CHANNEL_IN >M_CHANNEL_OUT; and when M_HEAD_IN<M_HEAD_OUT, the supply flow channel and the recovery flow channel are adjusted so as to satisfy a condition of M_CHANNEL_IN <M_CHANNEL_OUT.

13. The liquid ejection apparatus as defined in claim 12, wherein the supply flow channel and the recovery flow channel are adjusted while flow channel diameters and flow channel lengths of the supply flow channel and the recovery flow channel are selected so as to satisfy the condition.

14. The liquid ejection apparatus as defined in claim 12, wherein the supply flow channel and the recovery flow channel are adjusted while at least one of the supply flow channel and the recovery flow channel is provided with at least one of a filtering device and a deaeration device so as to satisfy the condition.

15. The liquid ejection apparatus as defined in claim 12, further comprising:

a supply tank to which the supply flow channel is connected; and a recovery tank to which the recovery flow channel is connected, wherein the liquid is supplied to the head by a hydraulic head pressure differential between the supply tank and the recovery tank.

16. The liquid ejection apparatus as defined in claim 12, further comprising:

a supply pump which is configured to convey the liquid to the head through the supply flow channel;

a supply damper which is arranged in the supply flow channel;

a recovery pump which is configured to convey the liquid from the head through the recovery flow channel; and a recovery damper which is arranged in the recovery flow channel.

17. A liquid ejection apparatus, comprising:

a head comprising a plurality of head modules, each of the head modules including: a nozzle which is configured to eject liquid; an individual supply port to which the liquid is continuously supplied; and an individual recovery port from which the liquid is continuously recovered;

a plurality of individual supply flow channels through which the liquid is supplied respectively to the head modules;

a common supply flow channel through which the liquid is supplied to the individual supply flow channels having distributary connections with the common supply flow channel;

a plurality of individual recovery flow channels through which the liquid is recovered respectively from the head modules; and a common recovery flow channel through which the liquid is recovered from the individual recovery flow channels having tributary connections with the common recovery flow channel, wherein:

an inertance inside each of the head modules from the individual supply port to the nozzle is M_MODULE_IN, an inertance inside each of the head modules from the nozzle to the individual recovery port is M_MODULE_OUT, an inertance of the common supply flow channel is M_C-CHANNEL_IN, and an inertance of the common recovery flow channel is M_C-CHANNEL_OUT;

when M_MODULE_IN>M_MODULE_OUT, the common supply flow channel and the common recovery flow channel are adjusted so as to satisfy a condition of M_C-CHANNEL_IN>M_C-CHANNEL_OUT; and when M_MODULE_IN<M_MODULE_OUT, the common supply flow channel and the common recovery flow channel are adjusted so as to satisfy a condition of M_C-CHANNEL_IN<M_C-CHANNEL_OUT.

18. The liquid ejection apparatus as defined in claim 17, wherein:

an inertance of each of the individual supply flow channels is M_I-CHANNEL_IN, and an inertance of each of the individual recovery flow channels is M_I-CHANNEL_OUT;

when M_MODULE_IN>M_MODULE_OUT, the individual supply flow channels, the individual recovery flow channels, the common supply flow channel and the common recovery flow channel are adjusted so as to satisfy conditions of M_I-CHANNEL_IN>M_I-CHANNEL_OUT, and M_C-CHANNEL_IN>M_C-CHANNEL_OUT; and when M_MODULE_IN<M_MODULE_OUT, the individual supply flow channels, the individual recovery flow channels, the common supply flow channel and the common recovery flow channel are adjusted so as to satisfy conditions of M_I-CHANNEL_IN<M_I-CHANNEL_OUT, and M_C-CHANNEL_IN<MS-CHANNEL_OUT.

19. The liquid ejection apparatus as defined in claim 18, wherein the individual supply flow channels, the individual recovery flow channels, the common supply flow channel and the common recovery flow channel are adjusted while flow channel diameters and flow channel lengths of the individual supply flow channels, the individual recovery flow channels, the common supply flow channel and the common recovery flow channel are selected so as to satisfy the conditions.

20. The liquid ejection apparatus as defined in claim 17, wherein the individual supply flow channels, the individual recovery flow channels, the common supply flow channel and the common recovery flow channel are adjusted while at least one of the individual supply flow channels, the individual recovery flow channels, the common supply flow channel and the common recovery flow channel is provided with at least one of a filtering device and a deaeration device so as to satisfy the conditions.

21. The liquid ejection apparatus as defined in claim 17, further comprising:

a supply tank to which the common supply flow channel is connected; and a recovery tank to which the common recovery flow channel is connected, wherein the liquid is supplied to the head by a hydraulic head pressure differential between the supply tank and the recovery tank.

22. The liquid ejection apparatus as defined in claim 17, further comprising:

a supply pump which is configured to convey the liquid to the head through the common supply flow channel;

a supply damper which is arranged in the common supply flow channel;

a recovery pump which is configured to convey the liquid from the head through the common recovery flow channel; and a recovery damper which is arranged in the common recovery flow channel.

* * * * *